US007699212B2

(12) United States Patent
Turvey et al.

(10) Patent No.: US 7,699,212 B2
(45) Date of Patent: Apr. 20, 2010

(54) COLLAPSIBLE STORAGE DEVICE AND METHOD OF MAKING THE SAME

(75) Inventors: Robert R. Turvey, Sanford, MI (US); Brian C. Dais, Saginaw, MI (US); Sanjay Dhall, Canton, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 1409 days.

(21) Appl. No.: 11/102,965

(22) Filed: Apr. 11, 2005

(65) Prior Publication Data

US 2005/0224563 A1 Oct. 13, 2005

Related U.S. Application Data

(60) Provisional application No. 60/561,497, filed on Apr. 13, 2004.

(51) Int. Cl.

| | |
|---|---|
| ***B65D 3/10*** | (2006.01) |
| ***B65D 5/00*** | (2006.01) |
| ***B65D 13/00*** | (2006.01) |
| ***B65D 5/36*** | (2006.01) |
| ***B65D 43/08*** | (2006.01) |
| ***B65D 6/00*** | (2006.01) |
| ***B65D 8/14*** | (2006.01) |
| ***B65D 30/10*** | (2006.01) |
| ***B65D 33/02*** | (2006.01) |
| ***B65D 21/00*** | (2006.01) |
| ***B65D 85/62*** | (2006.01) |

(52) U.S. Cl. ..... 229/117.02; 229/117.07; 229/117.05; 229/125.26; 229/5.5; 229/917; 206/508; 220/6; 220/9.3; 220/9.2

(58) Field of Classification Search ..... 229/117.02, 229/117.05, 117.07, 5.5, 915, 120.21, 117.01, 229/119, 125.26, 917; 206/508, 6, 9.3, 9.2; 220/780, 789, 907, 801, 6, 9.3, 9.2
See application file for complete search history.

(56) References Cited

U.S. PATENT DOCUMENTS 70,598 A 11/1867 Morgan (Continued)

FOREIGN PATENT DOCUMENTS

DE 4418666 A1 12/1980

(Continued)

OTHER PUBLICATIONS

International Search Report in PCT/US2005/012430 dated Oct. 7, 2005.

(Continued)

*Primary Examiner*—Gary E Elkins
*Assistant Examiner*—Latrice Byrd

(57) ABSTRACT

A collapsible storage device includes a collapsible container and a lid for the container. The container includes a plurality of resilient wall panels and a flexible hinge connecting each adjacent pair of wall panels. The container may be foldably converted between a substantially flat collapsed position and a substantially rectangular prismatic expanded position by articulating the wall panels about the flexible hinges. One side of the lid is adapted to cover an opening into the container when the container is in an expanded position. The opposite side of the lid is adapted to receive the substantially flat collapsed container within a recess in the lid.

19 Claims, 15 Drawing Sheets

U.S. PATENT DOCUMENTS

| | | | | |
|---|---|---|---|---|
| 241,254 | A | | 5/1881 | Udell |
| 680,186 | A | | 8/1901 | Van Wormer |
| 734,449 | A | | 7/1903 | Van Wormer |
| 798,264 | A | | 8/1905 | Carrier |
| 886,462 | A | | 5/1908 | Amos |
| 1,354,928 | A | | 10/1920 | Watson |
| 1,855,045 | A | | 4/1932 | Filmer |
| 1,906,174 | A | | 4/1933 | Miller |
| 1,921,946 | A | * | 8/1933 | Rudowitz ..... 229/117.05 |
| 2,006,811 | A | | 7/1935 | Mersbach |
| 2,067,998 | A | | 1/1937 | Williamson |
| 2,859,905 | A | | 11/1958 | Choate |
| 2,914,210 | A | | 11/1959 | Paston |
| 3,254,786 | A | | 6/1966 | Melville |
| 3,354,924 | A | | 11/1967 | Birrell et al. |
| 3,369,727 | A | | 2/1968 | Wright |
| 3,376,994 | A | | 4/1968 | Flinn, Jr. |
| 3,424,365 | A | | 1/1969 | Venturi |
| 3,445,052 | A | | 5/1969 | Lewallen |
| 3,497,127 | A | | 2/1970 | Box |
| 3,635,361 | A | * | 1/1972 | Hayes ..... 206/510 |
| 3,655,114 | A | | 4/1972 | Turner |
| 3,796,342 | A | | 3/1974 | Sanders et al. |
| 3,858,745 | A | | 1/1975 | Cloyd |
| 3,870,185 | A | | 3/1975 | Sanders et al. |
| 3,955,703 | A | | 5/1976 | Zebarth |
| 4,005,795 | A | | 2/1977 | Mikkelsen et al. |
| 4,057,165 | A | | 11/1977 | Kardell |
| 4,064,206 | A | | 12/1977 | Seufert |
| 4,164,316 | A | | 8/1979 | Gooding |
| 4,179,252 | A | | 12/1979 | Seufert |
| 4,235,345 | A | | 11/1980 | VandeDrink et al. |
| 4,235,346 | A | | 11/1980 | Liggett |
| 4,252,266 | A | | 2/1981 | Kupersmit |
| 4,405,077 | A | * | 9/1983 | Kupersmit ..... 229/117.07 |
| D285,906 | S | | 9/1986 | Tyler |
| 4,678,095 | A | | 7/1987 | Barnett et al. |
| 4,684,034 | A | | 8/1987 | Ono et al. |
| 4,694,986 | A | | 9/1987 | Chou |
| 4,700,862 | A | * | 10/1987 | Carter et al. ..... 220/6 |
| 4,717,524 | A | | 1/1988 | Aoki |
| 4,722,473 | A | | 2/1988 | Sandrini et al. |
| 4,746,059 | A | | 5/1988 | Jackson |
| 4,757,909 | A | | 7/1988 | Matsuura |
| 4,780,261 | A | | 10/1988 | Vajtay |
| 4,781,300 | A | | 11/1988 | Long |
| 4,790,714 | A | | 12/1988 | Schnapp |
| 4,813,200 | A | | 3/1989 | Kirchner |
| 4,819,824 | A | | 4/1989 | Longbottom et al. ..... 220/266 |
| 4,826,039 | A | | 5/1989 | Landis |
| 4,828,132 | A | | 5/1989 | Francis, Jr. et al. |
| 4,872,586 | A | | 10/1989 | Landis |
| 4,886,184 | A | | 12/1989 | Chamourian |
| 4,930,644 | A | | 6/1990 | Robbins, III |
| 4,938,413 | A | | 7/1990 | Wolfe |
| 4,946,430 | A | | 8/1990 | Kohmann |
| 4,948,039 | A | | 8/1990 | Amatangelo |
| 4,953,735 | A | | 9/1990 | Tisbo et al. |
| D318,015 | S | | 7/1991 | DeCoster et al. |
| 5,042,713 | A | * | 8/1991 | Stafford ..... 229/117.02 |
| 5,048,707 | A | | 9/1991 | Hallberg |
| 5,064,068 | A | | 11/1991 | Sheng |
| 5,081,740 | A | | 1/1992 | Smith |
| 5,183,672 | A | | 2/1993 | Fetterhoff et al. |
| D336,613 | S | | 6/1993 | Zutler |
| D336,850 | S | | 6/1993 | Guillin |
| 5,230,689 | A | | 7/1993 | Derby |
| 5,257,707 | A | * | 11/1993 | Soede ..... 220/4.29 |
| 5,268,138 | A | | 12/1993 | Fetterhoff et al. |
| 5,275,300 | A | | 1/1994 | Johnson |
| 5,292,242 | A | | 3/1994 | Robbins, III |
| 5,299,704 | A | | 4/1994 | Thorby |
| 5,300,748 | A | | 4/1994 | Colombo |
| D354,436 | S | | 1/1995 | Krupa |
| 5,384,138 | A | | 1/1995 | Robbins, III |
| D358,936 | S | | 6/1995 | Wagaman, III |
| 5,437,386 | A | | 8/1995 | Von Holdt |
| 5,472,107 | A | | 12/1995 | Lieber |
| D366,212 | S | | 1/1996 | Jones |
| D366,830 | S | | 2/1996 | Christianson |
| D367,609 | S | | 3/1996 | Frank et al. |
| 5,501,758 | A | | 3/1996 | Nitardy |
| 5,524,789 | A | | 6/1996 | Jackman |
| 5,554,093 | A | | 9/1996 | Porchia et al. |
| 5,555,989 | A | | 9/1996 | Moran, Jr. |
| 5,575,398 | A | | 11/1996 | Robbins, III |
| 5,622,276 | A | | 4/1997 | Simmons |
| D387,272 | S | | 12/1997 | Lippincott |
| 5,699,914 | A | | 12/1997 | Broersma |
| 5,699,925 | A | | 12/1997 | Petruzzi |
| 5,699,959 | A | * | 12/1997 | Huspeka et al. ..... 229/125.26 |
| 5,735,423 | A | | 4/1998 | Black |
| 5,743,405 | A | | 4/1998 | Reid |
| 5,746,871 | A | | 5/1998 | Walsh |
| 5,762,262 | A | * | 6/1998 | Martin ..... 229/120.21 |
| 5,772,070 | A | | 6/1998 | Hayes et al. |
| 5,772,110 | A | | 6/1998 | Garretson |
| 5,785,179 | A | | 7/1998 | Buczwinski et al. |
| 5,833,116 | A | | 11/1998 | Guillin |
| 5,839,604 | A | | 11/1998 | Straussman |
| 5,868,268 | A | * | 2/1999 | Walker ..... 220/379 |
| D409,484 | S | | 5/1999 | Tasker |
| 5,918,743 | A | | 7/1999 | Uitz |
| D415,680 | S | | 10/1999 | Sheffer |
| 5,975,411 | A | | 11/1999 | Windolph, III |
| 5,979,690 | A | | 11/1999 | Hartley |
| 5,996,882 | A | | 12/1999 | Randall |
| D421,901 | S | | 3/2000 | Hill |
| D421,902 | S | | 3/2000 | Hill |
| 6,032,815 | A | | 3/2000 | Elstone |
| 6,050,410 | A | | 4/2000 | Quirion |
| 6,050,482 | A | | 4/2000 | Cai |
| 6,056,138 | A | | 5/2000 | Chen |
| D427,063 | S | | 6/2000 | May |
| 6,092,687 | A | | 7/2000 | Hupp et al. |
| 6,098,827 | A | | 8/2000 | Overholt et al. |
| 6,102,280 | A | | 8/2000 | Dowd |
| 6,112,928 | A | | 9/2000 | Black et al. |
| 6,116,501 | A | | 9/2000 | Hupp |
| 6,126,065 | A | | 10/2000 | Wee |
| 6,170,696 | B1 | | 1/2001 | Tucker et al. |
| D437,686 | S | | 2/2001 | Balzar et al. |
| 6,196,404 | B1 | | 3/2001 | Chen |
| D442,081 | S | | 5/2001 | Paul |
| 6,245,277 | B1 | | 6/2001 | Diamond |
| 6,279,774 | B1 | | 8/2001 | Clute et al. |
| 6,315,151 | B1 | | 11/2001 | Hupp et al. |
| 6,325,239 | B2 | | 12/2001 | Randall et al. |
| 6,386,437 | B1 | | 5/2002 | Larson, Jr. |
| 6,401,968 | B1 | | 6/2002 | Huang et al. |
| 6,405,888 | B1 | | 6/2002 | Overholt et al. |
| 6,435,384 | B1 | | 8/2002 | Davis et al. |
| 6,564,960 | B1 | | 5/2003 | Grindstaff et al. |
| 6,585,129 | B2 | | 7/2003 | Moody et al. |
| 6,609,633 | B1 | | 8/2003 | Dyble et al. |
| 6,612,441 | B2 | | 9/2003 | Lang et al. |
| 6,648,159 | B2 | | 11/2003 | Prutkin et al. |
| 6,669,045 | B2 | | 12/2003 | Wang |
| 6,682,686 | B1 | | 1/2004 | Iwasaki et al. |
| D487,347 | S | | 3/2004 | Felsenthal |
| 6,761,279 | B1 | | 7/2004 | Martin et al. |
| D496,585 | S | | 9/2004 | McBride et al. |
| 6,805,659 | B2 | | 10/2004 | Bohrer |
| 6,976,602 | B1 | | 12/2005 | Maxwell |

| | | | |
|---|---|---|---|
| 2002/0179600 | A1 | 12/2002 | King |
| 2002/0189166 | A1 | 12/2002 | Weder |
| 2003/0010814 | A1 | 1/2003 | Lorusso |
| 2003/0052158 | A1 | 3/2003 | Spindel et al. |
| 2003/0168452 | A1 | 9/2003 | Prutkin et al. |
| 2004/0069780 | A1 | 4/2004 | Apps et al. |
| 2004/0155037 | A1 | 8/2004 | Hoogland |
| 2004/0164132 | A1 | 8/2004 | Kuester |
| 2005/0035186 | A1 | 2/2005 | Casalotto |
| 2005/0061859 | A1 | 3/2005 | Hennessy |
| 2005/0230390 | A1 | 10/2005 | Glenn |
| 2007/0007289 | A1 | 1/2007 | Hoberman |
| 2007/0045311 | A1 | 3/2007 | Wang |

FOREIGN PATENT DOCUMENTS

| | | | |
|---|---|---|---|
| EP | 76624 | A1 | 4/1983 |
| GB | 1580996 | | 12/1980 |
| GB | 2367283 | A | 4/2002 |

OTHER PUBLICATIONS

Hoberman Transformable Design: Architecture, "Storage", http://www.hoberman.com/site/storage/storage.html, 1 page, Printed Jan. 23, 2007.
Hoberman Transformable Design: Architecture, "Future", http://www.hoberman.com/site/future/future.html, 1 page, Printed Jan. 23, 2007.
Hoberman Transformable Design: Who We Are, http://www.hoberman.com/site/who_we_are/history.html, 2 pages, Printed Jan. 23, 2007.
Columbia Magazine, "The Future Tents", http://www.columbia.edu/cu/alumni/Magazine/Spring2006/hoberman.., 8 pages, Printed Jan. 23, 2007.
Web Page "Pactiv Air® Systems," at http://pactiv.corn/PactivAir/ dated Sep. 18, 2004 (1 page).
Web Page "Hefty Express®," at http://www.pactiv.com/Heftyexpress/indexmailers.asp dated Sep. 18, 2004 (1 page).
Web Page "Hefty® Slide-Rite® Closure Solutions," at http://pactiv.com/sliderite/ dated Sep. 18, 2004 (1 page).
Web Page "Hinged Lid Containers," at http://pactivpartners.pactiv.com/productcatalog/Rooms/DisplayPages/LayoutInitial?Contai... dated Sep. 18, 2004 (1 page).
Web Page "Paperboard Hinged Take-Out Containers," at http://pactivpartners.pactiv.com/productcatalog/Rooms/DisplayPages/LayoutInitial?Contai... dated Sep. 18, 2004 (1 page).
Web Page "Kitchen Seal n Saver Containers," at http://www.rubbermaid.com/hpd/consumer/product/list.jhtml dated Sep. 18, 2004 (1 page).
Web Page "Stuffables™ Storage Containers," at http://order.tupperware.com/ls/htprod_www/tup_show_item.show_item_detail dated Sep. 18, 2004 (1 page).
Web Page "FlatOut! Containers," at http://il3.ebayimg.com/03/i/02/4a/c6/bb_1_b.JPG dated Sep. 18, 2004 (1 page).
Web Page "SmartCrate™," at http://www.ipl-mh.com/returnable_containers.asp dated Sep. 20, 2004 (1 page).
Web Page "Techno Bin," at http://www.techcontainer.com/bulkbins.html dated Sep. 20, 2004 (1 page).
Web Page "ComboFructus," at http://www.packagingnetwork.com/content/productshowcase/prodct.asp?docid=140155e... dated Sep. 19, 2004 (1 page).
Web Page "The Repak Insulated Pallet Shipper," at http://www.packagingnetwork.com/content/productshowcase/product.asp?docid=03b28f71... dated Sep. 19, 2004 (1 page).
Web Page Heavy Duty Collapsible Bin Box, 48" × 40" at http://www.cisco-eagle.com/miva/merchant.mv?Screen=PROD&Store_Code=CEI&Produ... dated Sep. 18, 2004 (1 page).
Web Page "Xytec Gemini," at http://www.packagingnetwork.com/content/productshowcase/product.asp?docid=1401552... dated Sep. 19, 2004 (1 page).
Web Page "Melog™ Collapsible Hand-Held Container," at http://www.packagingnetwork.com/content/productshowcase/product.asp?docid=7d478a0... dated Sep. 19, 2004 (1 page).
Web Page "Collapsible Plastic Tote Bin," at http://www.packagingnetwork.com/content/productshowcase/product.asp?docid=6e4bc74... dated Sep. 19, 2004 (1 page).
Web Page "Packaging Network: Digital Marketplace for the Packaging Industry," at http://www.packagingnetwork.com/Catalgo2/CatalogBrowse.asp?CatID=RehrigPacific&B... dated Sep. 19, 2004 (1 page).
Web Page "IPL SmartCrate for Eggs," at http://www.packagingnetwork.com/content/productshowcase/product.asp?docid=4f27cfl9... dated Sep. 19, 2004 (1 page).
Web Page "Folding Crate," at http://www.containerstore.com/browse/Product.jhtml?PRODID=60192&CATID=239 dated Sep. 19, 2004 (1 page).
Web Page "Rubbermaid Collapsible Crate," at http://www.amazon.com/exec/obidos/tg/detail/-/B00019JP92/ref=k_de_a_smp/104-28421... dated Sep. 18, 2004 (1 page).
Web Page "Plastic Collapsible Containers," at http://www.cherrysind.com/ci/palletscontainers/plastic-collapsible-container.shtml dated Sep. 18, 2004 (6 pages).
Web Page "Storage Boxes Graphite," at http://www.containerstore.com/browse/Product.jhtml?PRODID=59856&CATID=71230 dated Sep. 19, 2004 (1 page).
Web Page "Collapsible, Reusable Carton," at http://www.packagingnetwork.com/content/productshowcase/productasp?docid=5282cfa8... dated Sep. 19, 2004 (1 page).
Web Page "Returnable, Reusable, Collapsible Containers," at http://www.packagingnetwork.com/content/productshowcase/product.asp?doci=ca4cc9a0... dated Sep. 19, 2004 (1 page).
Web Page "Black Wave Flute Gift Boxes," at http://www.containerstore.com/browse/Product.jhtml?PRODID=62644&CATID=262 dated Sep. 19, 2004 (1 page).
Web Page "Collapsible Container—Magic," at http://www.magicgoods.com/CollapContM.htm dated Sep. 18, 2004 (1 page).
Web Page "Blue Folding Mesh Cubes," at http://www.containerstore.com/browse/Product.jhtml?PRODID=72108&CATID=166 dated Sep. 19, 2004 (1 page).
Web Page "Professional's Choice Collapsible Trash and Laundry Container," at http://www.statelinetack.com/global/product_large_img.jsp?PRODUCT<>ord_ud=745524... dated Sep. 18, 2004 (1 page).
Web Page "Exotainer," at http://www.packagingnetwork.com/content/productshowcase/product.asp?docid=c4e6fa99... dated Sep. 19, 2004 (1 page).
Web Page "Drake Stand-Up Decoy Bags," at http://www.cabelas.com/cabelas/en/templates/product/standard-item.jhtml?id=0027683226... dated Sep. 19, 2004 (1 page).
Web Page "NRS Big Basin Water Container," at http://www.nrsweb.com/shop/product.asp?pfid=2051&src=froogle&refer=2051 dated Sep. 18, 2004 (1 page).
Web Page "Double Folding Mesh Cube," at http://www.thecontainerstore.com/browse/Product.jhtml?CATID=166&PRODID=69699&... dated Sep. 17, 2004 (1 page).
Web Page "Making Memories® Crop Can Black Mesh," at http://www.createforless.com/products/productDetail.asp-?ProductID=76177&GCID=C106... dated Sep. 18, 2004 (1 page).
Web Page "Water Storage Collapsible Water Containers," at http://lowprice4u.com/shoppingcart/ProductTemplate.ASP?Product-TemplateID=21078&F... dated Sep. 18, 2004 (1 page).
Web Page "Collapsible Fold-A-Jug Water Container," at http://www.preparedness.com/colfolwatcon.html dated Sep. 18, 2004 (1 page).
Web Page "Crunch Cans," at http://www.containerstore.com/browse/Product.jhtml?PRODID=62672&CATDID=223 dated Sep. 19, 2004 (1 page).
Web Page "Corner Crunch Canvas Hamper," at http://www.organizes-it.com/pocornercrunch.php dated Sep. 19, 2004 (1 page).
Web Page "Crunch Oval Laundry Basket," http://www.organizes-it.com/poovalcrunch.php dated Sep. 19, 2004 (1 page).
Web Page "Outcast Cooler Bags," at http://www.cabelas.com/cabelas/en/templates/product/standard.item.jhtml?id=0018142316... dated Sep. 19, 2004 (1 page).
Web Page "Collapsible Storage Organizer," at http://www.coleman.com/coleman/colemancom/detail.asp?product_id=816-100&categoryi... dated Sep. 19, 2004 (1 page).

Web Page "Artic Zone Ultimate 6 Can Collapsible Cooler New w/Tag," at http://cgi.ebay.com/ws/eBayISAPI.dll?ViewItem&category=11703&item=4308355535&r... dated Sep. 18, 2004 (1 page).

Web Page "Collapsible Insulated Lunch Bag Cooler," at http://cgi.ebay.com/ws/eBayISAPI.dll?ViewItem&category=11703 &item=4324976900&r... dated Sep. 18, 2004 (1 page).

Web Page "Cubitainer-5 Gallon," at http://www.thegrape.net/browse.cfm/4,9380.html dated Sep. 18, 2004 (1 page).

Web Page "Collapsible Water Jug Container, 5 Gallon," http://www.gr8gear.com/index.asp?PageAction=VIEWPROD&ProdID=2948 dated Sep. 18, 2004 (1 page).

Catalog Page from Cole-Parmer "Collapsible Container, LDPE," (p. 850).

Web Page "Lewis N. Clark Travel Cup with Pill Container," at http://www.rei.com/online/store/ProductDisplay?productId =47780043 &storied=8000&cat... dated Sep. 18, 2004 (1 page).

Web Page "Fold 'n Hold," at http://www.inventorsstudio.com/FoldnHold.html dated Apr. 8, 2004 (2 pages) and Product Packaging Photocopies (4 pages).

Picture of "Collapsible Cubes," by Whitmor.

U.S. Appl. No. 11/361,530, Office Action dated Feb. 20, 2009.

* cited by examiner

COLLAPSIBLE STORAGE DEVICE AND METHOD OF MAKING THE SAME

CROSS REFERENCE TO RELATED APPLICATIONS

This application claims the benefit of U.S. Provisional Application No. 60/561,497 filed on Apr. 13, 2004.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Technical Field

The present invention is directed toward a device for storing objects, and more particularly a collapsible storage device.

2. Background Art

It is sometimes desirable to have a storage device in which the device is convertible between an expanded position and a collapsed position. In the expanded position, the storage device is capable of retaining objects within an interior space. In the collapsed position, the storage device has less or even no storage capabilities but is more convenient to store because it takes up less space.

One storage device is a collapsible metal box container having a bottom, four sides, and a lid. The bottom and four sides are connected to each other with pin and knuckle hinges, and the lid is connected to one of the sides with pin and knuckle hinges. Each of the bottom and two opposing sides is divided into a pair of opposing triangular segments that are connected to each other with pin and knuckle hinges. The box can be folded or unfolded between an expanded box shape and a substantially flat or planar collapsed shape.

Another storage device is a collapsible cardboard container having a square bottom, four rectangular side walls extending upwardly from the bottom, and an opening opposite the bottom. A removable lid is provided to cover the opening with a peripheral flange fitting about the side walls. Each side wall is separated into three sections, and at least one of the sections of each of the four side walls is divided into a pair of hingedly connected opposing triangular segments. The container may be folded between a collapsed position and an expanded position by twisting the side walls to either fold or unfold the triangular segments.

SUMMARY OF THE INVENTION

In one aspect of the invention, a storage device includes a container having a plurality of resilient wall panels defining four side walls and a bottom wall, wherein each adjacent pair of wall panels is joined by a flexible hinge such that the container is articulably convertible about the hinges between a substantially flat collapsed position and an expanded position defining an opening into an interior of the container. The storage device also has a lid that receives the container in the collapsed position and sealingly covers the opening of the container in the expanded position.

In another aspect of the invention, a collapsible container includes a plurality of resilient wall panels, each adjacent pair of which is articulably connected with a flexible hinge extending therebetween. The wall panels articulate about each of the flexible hinges between a substantially flat collapsed position and a substantially rectangular prismatic expanded position that defines a substantially rectangular opening into an interior space.

These and other aspects and advantages of the present invention will become apparent upon consideration of the following detailed description in which;

DETAILED DESCRIPTION

Figure 1:
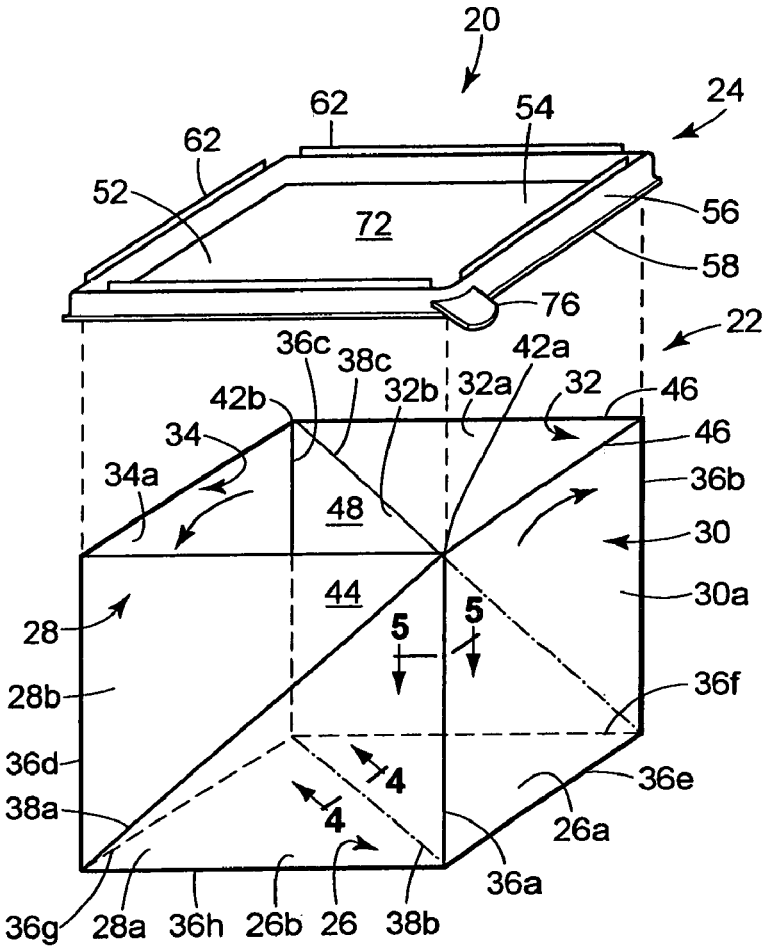
FIG. 1 is an isometric view of a collapsible storage device according to one embodiment of the invention with a lid over an opening of a collapsible container in an expanded position.
Figure 2:
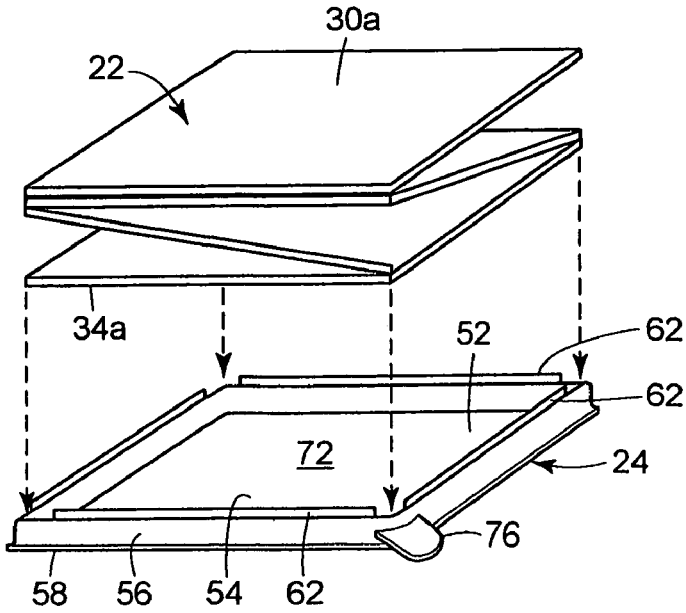
FIG. 2 is an isometric view of the storage device of FIG. 1 with the collapsible container in a collapsed position and ready to be placed in a recessed portion of the lid.
Figure 3:
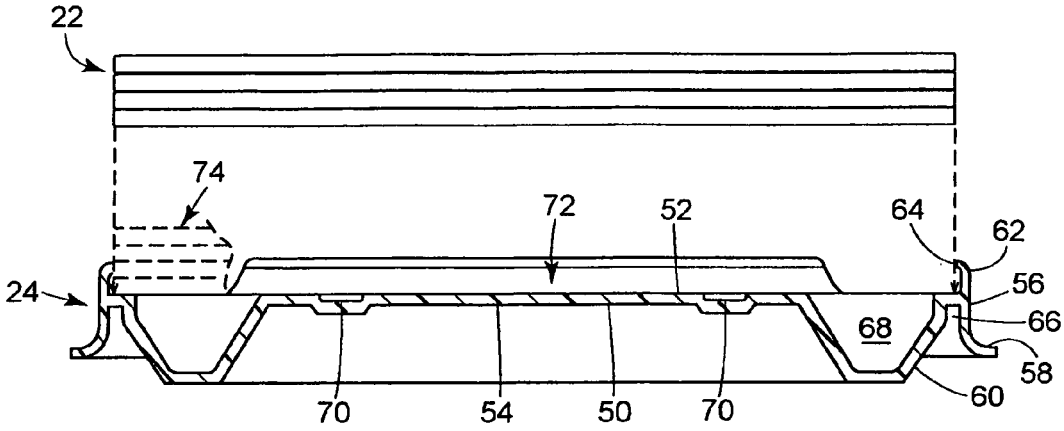
FIG. 3 is a vertical cross-sectional view of the storage device of FIG. 2 with the collapsed collapsible container partly shown fitted into the recessed portion of the lid.

Referring now to FIGS. 1-3, a single unit storage device 20 according to the present invention includes a collapsible container 22 and a lid 24. The container 22 includes resilient wall panels connected by flexible hinges that are convertible between an expanded position as shown in FIG. 1 and a collapsed position as shown in FIG. 2. The container 22 and lid 24 in one embodiment are made of a blow molded thermoplastic, such as polypropylene, polyethylene, or other polyolefin, nylon, or other resilient polymeric material. In another embodiment, the container 22 and the lid 24 are made of organic or biodegradable polymers, such as polyesters based on lactic acid (e.g., PLA). The container 22 includes a bottom wall 26 and four side walls 28, 30, 32, 34 extending upwardly from the outer periphery of the bottom wall. Each of the bottom wall 26 and the side walls 28, 30, 32, 34 is substantially square in shape, although one or more of the walls may have a different shape. Each of the bottom wall 26 and the side walls 28, 32 includes a pair of complimentary triangular panels 26*a*, 26*b*, 28*a*, 28*b*, and 32*a*, 32*b*, respectively, wherein the panels of each pair are hingedly joined to form the respective wall. Each of the side walls 30, 34 comprises a single panel 30*a*, and 34*a*, respectively. Each panel 26*a*, 26*b*, 28*a*, 28*b*, 30*a*, 32*a*, 32*b*, and 34*a* is connected to adjacent panels by one of living hinges 36*a*, 36*b*, 36*c*, 36*d*, 36*e*, 36*f*, 36*g*, 36*h*, 38*a*, 38*b*, 38*c* such that the container 22 may be converted from the expanded position of FIG. 1 to the substantially flat collapsed position of FIG. 2. This conversion is accomplished by moving the panel 30 and the panel 34 in opposite directions (as seen in FIG. 1) so that corners 42*a* and 42*b* converge toward one another. Continued opposite movement of the panels 30*a* and 34*a* results in rotation of the panel 30*a* clockwise and rotation of the panel 34*a* counterclockwise (as seen in FIG. 1) 90 degrees with respect to each other, during which time the panels 26*a* and 26*b*, 28*a* and 28*b*, and 32*a* and 32*b* collapse inwardly toward one another in a folding motion about the hinges 38*b*, 38*a*, and 38*c*, respectively. This collapsing is afforded by movement of the panels 26*a*, 26*b*, 28*a*, 28*b*, 30*a*, 32*a*, 32*b*, and 34*a* about the living hinges 36*a*-*h*, 38*a*-*c*. Eventually, the panels 26*a*, 26*b*, 28*a*, 28*b*, 30*a*, 32*a*, 32*b*, and 34*a* collapse into the configuration shown in FIG. 2. The collapsed container 22 may be expanded by reversing the process. Another method of converting the container 22 to the collapsed position is to push bottom hinge 38*b* upwardly (as depicted in FIG. 1) and hinges 38*a*, 38*b* inwardly, which causes the same folding/collapsing motion of the panels 26*a,b*; 28*a,b*; and 32*a,b* as heretofore described.

In the expanded position, the bottom wall 26 and side walls 28-34 of the container 22 define an interior space 44 and upper edges 46 of the side walls 28-34 define an opening 48 into the interior space. The interior space 44 of the expanded container 22 may be filled through opening 48 with a product (not shown). The force of the product contained within the interior space 44 pressing outwardly against the side walls 28, 32 and bottom wall 26, and hinges 38*a*-*c* assist in maintaining the container 22 in the expanded position by preventing the panels 26*a,b*; 28*a,b*; and 32*a,b* from collapsing inwardly, and in another embodiment, one or more latching mechanisms are used to maintain the container in the expanded position. The lid 24 is adapted to cover the opening 48 to completely enclose the interior space 44.

The lid 24 has a product side 50 and a stacking side 52 opposite the product side. The lid 24 includes a cover plate 54, a peripheral flange 56 with an out-flared skirt 58, a tapered lead-in 60, and a retaining wall 62 with an in-turned lip 64 along the upper edge. The flange 56 and lead-in 60 define a groove 66 extending around the outer periphery of the cover plate 54 on the product side 50 of the lid 24. The cover plate 54 is adapted to cover the opening 48 of the container 22 when in the expanded position with the upper edge 46 of the side walls 28-34 fitting into the peripheral groove 66 of the lid 24 so that the product side 50 is facing any product contained in the interior space 44. The tapered lead-in 60 and flared skirt 58 help guide the upper edge 46 of the side walls 28-34 into the groove 66 as the lid 24 is being placed over the opening 48. The lead-in 60 extends below the flared skirt 58 with a gentle enough taper to readily catch the side walls 28-34 and urge them outwardly if they are bowed inwardly. For this purpose, the lead-in 60 is preferably tapered inwardly (i.e., toward the center of the lid 24) from the groove 66 a distance greater than any anticipated inward bowing of the side walls 28-34. The lead-in 60 is preferably formed by the opposite side of a recessed channel 68 in the cover plate 54 inwardly spaced from the outer periphery of the cover plate; however, any form of tapered lead-in structure could be used. In one embodiment, the recessed channel 68 extends continuously around the cover plate 54, and in another embodiment, the recessed channel extends intermittently around the cover plate. Structural and esthetic relief indentations 70 in the cover plate 54 provide added structural integrity and esthetic designs to the lid 24. The retaining walls 62 protrude upwardly from and extend intermittently around the cover plate 54 to form a recess 72 on the stacking side 52 of the lid. The recess 72 is adapted to receive the container 22 in either the collapsed position or the expanded position so that the container can be stacked on to the stacking side 52 of the lid 24. The container 22 lies substantially flat within the recess 72 when in the collapsed position as partially depicted in dashed lines at 74 in FIG. 3. The lip 64 resiliently presses against the edges of at least one of the side walls 28-34 of the collapsed container 22 that is fitted within the recess 72 to releasably restrain the container within the recess by means of a snap-fit. A thumb tab 76 extending outwardly from the flange 56 provides a convenient mechanism for prying the lid 24 away from the container 22, both when the container is stacked within the recess 77, and when the lid is covering the opening 48.

Figure 4:
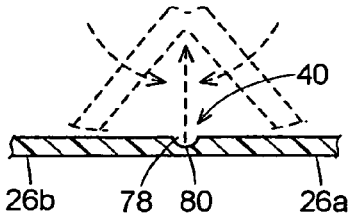
FIG. 4 is a fragmentary cross-sectional view taken generally along the lines 4-4 of FIG. 1.
Figure 5:
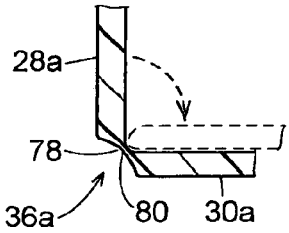
FIG. 5 is a fragmentary cross-sectional view taken generally along the lines 5-5 of FIG. 1.

Referring now to FIGS. 4 and 5, each living hinge 36*a-h* and 38*a-c* according to one embodiment of the present invention includes a notch 78 and a flexible hinge portion 80 as best seen in FIG. 4. The hinge portion 80 is slightly off center from the panel axis, which provides a measure of directionality to the hinge, and which conveniently lends itself to describing the hinges in the container 22 as being either interior hinges or exterior hinges. An interior hinge is a living hinge in which the hinge portion 80 is offset toward the interior space 44 of the expanded container 22. An exterior hinge is a living hinge in which the hinge portion 80 is offset away from the interior space 44 of the expanded container 22. Hinges 36*a-h* are interior hinges, and hinges 38*a-c* are exterior hinges. This placement of interior and exterior living hinges allows the hinge portion 80 of each of the hinges 36*a-h*, 38*a-c* to be rotated away from the notch 78 when converting the container 22 from the expanded position to the collapsed position as shown in FIGS. 4 and 5, which minimizes any interference between the panels on opposite sides of the hinge portion as those panels are rotated about the hinge portion.

Figure 6:
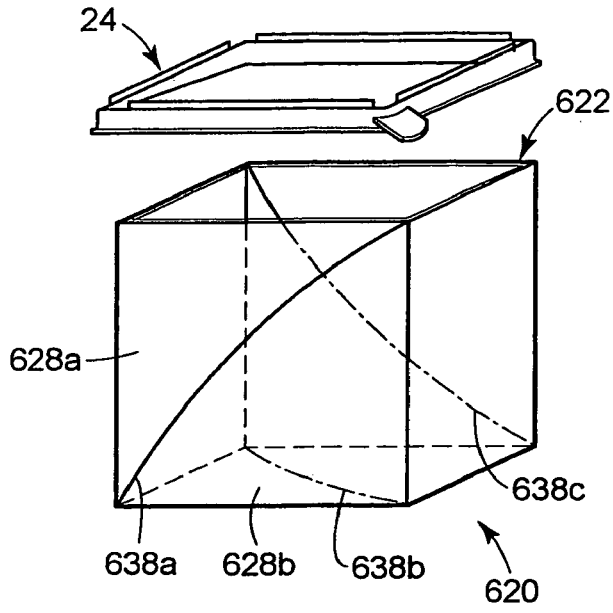
FIG. 6 is an isometric view of an embodiment of a collapsible container having arched living hinges.

Referring now to FIG. 6, another storage device 620 according to the present invention includes the lid 24 and a collapsible container 622, which is similar to container 22 in all respects except that hinges 638*a-c* are arched living hinges. An arched hinge is slightly curved between the two longitudinal ends of the hinge as shown for the hinges 638*a-c* in FIG. 6. (The curvature of the hinges 638*a-c* shown in FIG. 6 exaggerates the curvature of the hinges for illustrative purposes only.) In one embodiment, the amount of curvature is sufficient to cause the hinges 638*a-c* to be bi-modal, having a stressed mode when the hinges are folded and an unstressed mode when the hinges are not folded. This bi-modal stress tendency continually urges the container 622 toward the expanded position because the stressed folded mode of the hinges 638*a-c* in the collapsed position urges the side wall panels 626*a,b*; 628*a,b*; and 632*a,b* toward the unstressed unfolded mode of the expanded position. For the container 622, it is advantageous that the collapsed container can snap-fit into the recess 72 of the lid 24, which helps maintain the container in the collapsed position while being stored or stacked. For this purpose, it is also advantageous to use the lid 824, discussed in detail herein below, with container 622.

In one embodiment according to the present invention, the arched living hinges 638*a-c* are arched in the plane of the respective side or bottom, i.e., in-plane arched hinges. An in-plane arched hinge is formed having the edge of one panel 628*a* arched inwardly and having the opposing edge of opposing panel 628*b* arched outwardly complementary to the opposite panel edge. In another embodiment, the arched living hinges 638*a-c* bulge outwardly, or are arched out of the plane of the respective side or bottom, i.e., out-of-plane arched hinges. An out-of-plane arched hinge is formed by arcuately arching each of the opposing edges of two adjacent panels, such as 628*a* and 628*b*, outwardly. In a further embodiment, an out-of-plane arched hinge is formed by arching each opposing hingedly joined panel edge outwardly with a plurality of straight line segments that collectively form a convexly arched panel edge.

Figure 6A:
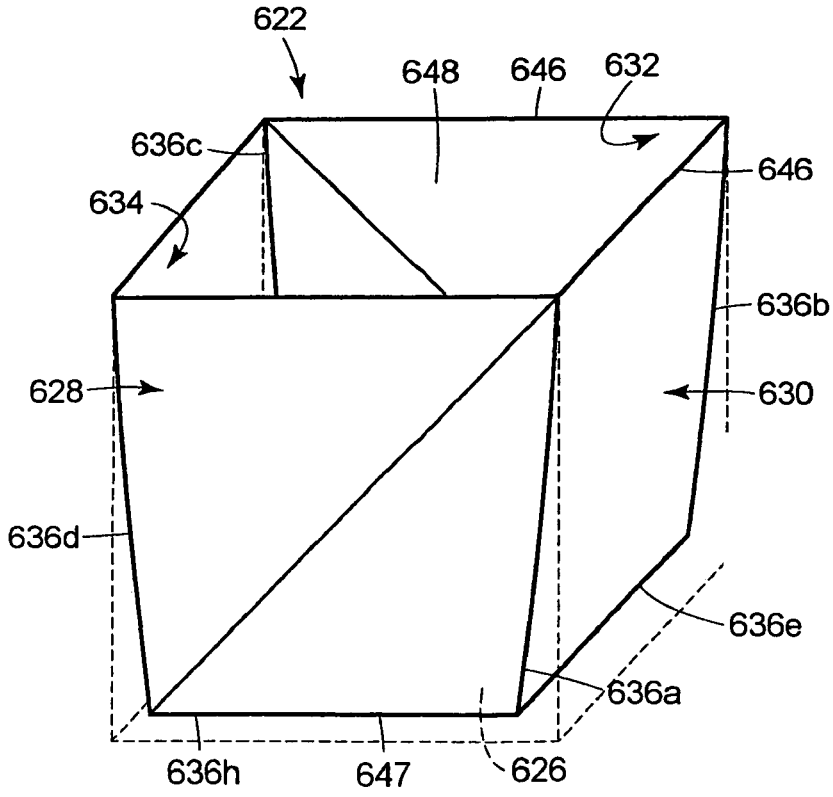
FIG. 6A is an isometric view of another embodiment of a collapsible container having arched living hinges.

In another embodiment according to the present invention having arched living hinges, shown in FIG. 6A, a collapsible container 622 is similar to the collapsible container 22, except that each of vertical corner hinges 636*a*, 636*b*, 636*c*, and 636*d* are out-of-plane arched hinges. Bottom wall 626 and opening 648 are square, sides 628, 630, 632, and 634 having straight upper edges 646 and straight bottom edges 647. In one embodiment, the opening 648 is larger than the bottom wall 626 so that the curved vertical hinges 636*a-d* are always inside a vertical projection of the opening 648 in order to facilitate easy ejection of the container 622 from a non-segmented mold. In another embodiment, the opening 648 is the same size as the bottom wall 626, and the curved vertical hinges 636*a-d* bow outwardly of the vertical projection of the opening. Other embodiment combinations of arched hinges include, having all of the hinges be out-of-plane arched hinges, having at least one of the hinges be an out-of-plane arched hinge with the remaining hinges being straight hinges, and having a combination of in-plane arched hinges, out-of-plane arched hinges, and straight hinges.

Figure 7:
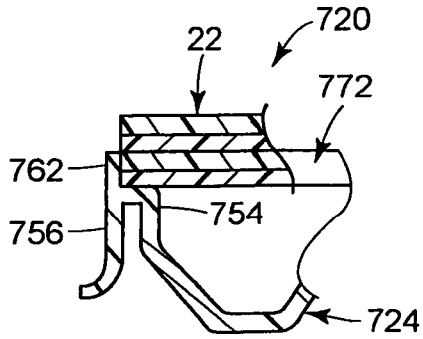
FIG. 7 is a fragmentary cross-sectional view similar to FIG. 3 of an embodiment of a storage device including a lid without a snap-fit retainer for retaining the collapsed collapsible container in the recess of the lid.

Referring now to FIG. 7, yet another embodiment according to the present invention similar to the storage device 20 includes the container 22 and a lid 724 similar to the lid 24. The lid 724 includes a cover plate 754, a peripheral flange 756, and a retaining wall 762 protruding above the peripheral flange 756 defining a recess 772 into which the collapsed container 22 may be fitted to lie flat against the cover plate 754. The retaining wall 762, however, is substantially smooth in that there is no in-turned lip along the upper edge of the wall, which allows the container 22 to slide freely into and out of the recess 772.

Figure 8:
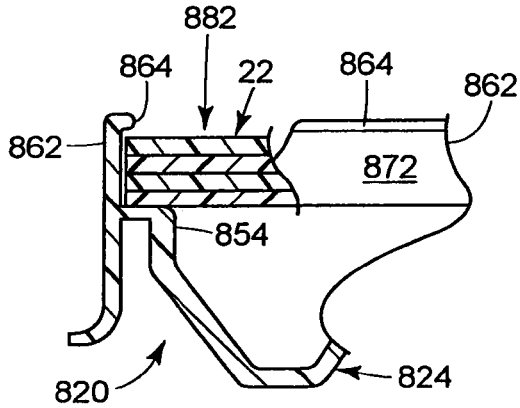
FIG. 8 is a fragmentary cross-sectional view similar to FIG. 7 of another embodiment of a storage device including a lid having a recess that completely accepts the collapsed collapsible container within a snap-fit retainer wall.

Referring now to FIG. 8, a further storage device 820 according to the present invention similar to the storage device 20 includes the container 22 and a lid 824 similar to the lid 24. The lid 824 includes a cover plate 854 and a retaining wall 862 that extends intermittently around the cover plate to define a recess 872. The retaining wall 862 protrudes upwardly from the cover plate 854 a height sufficient for the entire thickness of the collapsed container 22 to fit within the recess 872. An in-turned lip 864 along an upper edge of retaining wall 862 is spaced above the cover plate 854 a distance sufficient for the thickness of the entire collapsed container 22 to fit between the cover plate and the lip with a snap-fit. For this embodiment, it is convenient for a user of the storage device 820 that the intermittent retaining wall 862 defines an access notch 872 between adjacent sections of the wall, which allows the user access to the edge of the container 22 for prying the container past the lip 864 out of the recess 872.

Figure 9:
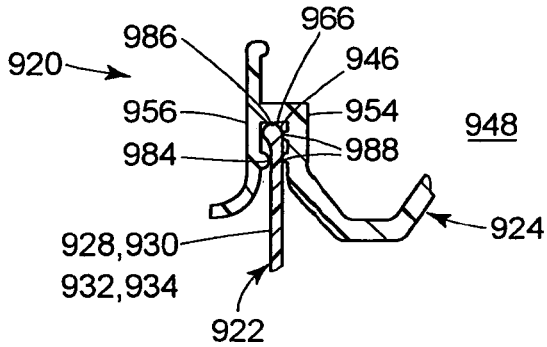
FIG. 9 is a fragmentary cross-sectional view similar to FIG. 7 of yet another embodiment of a storage device including a lid having a sealing mechanism and a snap-fit locking feature for retaining the lid on the side walls of the collapsible container.

Referring now to FIG. 9, another storage device 920 according to the present invention similar to the storage device 20 includes a collapsible container 922 similar to the container 22 and a lid 924 similar to the container 24. The container 922 includes four side walls 928, 930, 932, 934 that define an opening 948 when the container 922 is in the expanded position. The lid 924 includes a cover plate 954 and a peripheral flange 956 around the cover plate that defines a peripheral groove 966 for receiving the side walls 928, 930, 932, 934 of the container 922 in the expanded position. A retention mechanism for releasably snap-fitting the lid 924 to the container 922 when in the expanded position to cover the opening 948 includes a rib 984 protruding from the flange 956 into the groove 966 and an out-turned lip 986 about the upper periphery of the upper edge 946 of the side walls 928, 930, 932, 934. The lip 986 is adapted to snap resiliently past the rib 984 to provide a snap-fit of the side walls 928, 930, 932, 934 into the groove 966. A sealing mechanism for creating a seal between the lid 924 and the side walls 928, 930, 932, 934 when the lid is covering the opening 948 includes a seal ring 988 extending continuously around and protruding into the groove 966. The seal ring 988 may be one or more small ridges, flexible flaps, embedded o-rings, or some other sealing protrusion. When the side walls 928, 930, 932, 934 are fitted into the groove 966, the seal ring 988 abuts against the side walls to provide a seal between the lid 924 and the side walls. In one embodiment, a seal ring 988 that comprises small ridges is used on a lid 924 made of a relatively soft or pliable material. In another embodiment, an upper wall of the groove 966 in the lid 924 is urged into sealing engagement with a top portion of the upper edge 946 by resilient interaction between one or more retention ridges or bumps on the lid and the container, such as, for example, between the outturned lip 986 and the rib 984, or between similar structures.

Figure 11:
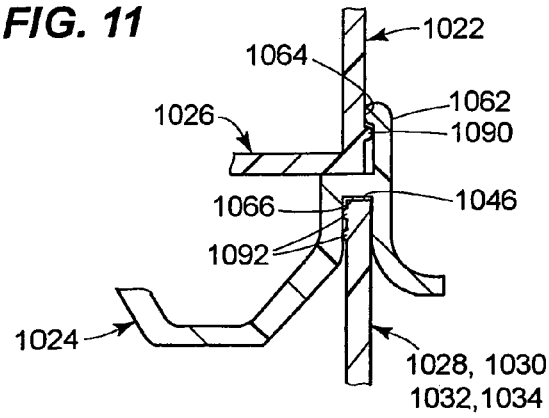
FIG. 11 is a fragmentary, enlarged, cross-sectional view of a portion of the lid and collapsible containers of FIG. 10.
Figure 10:
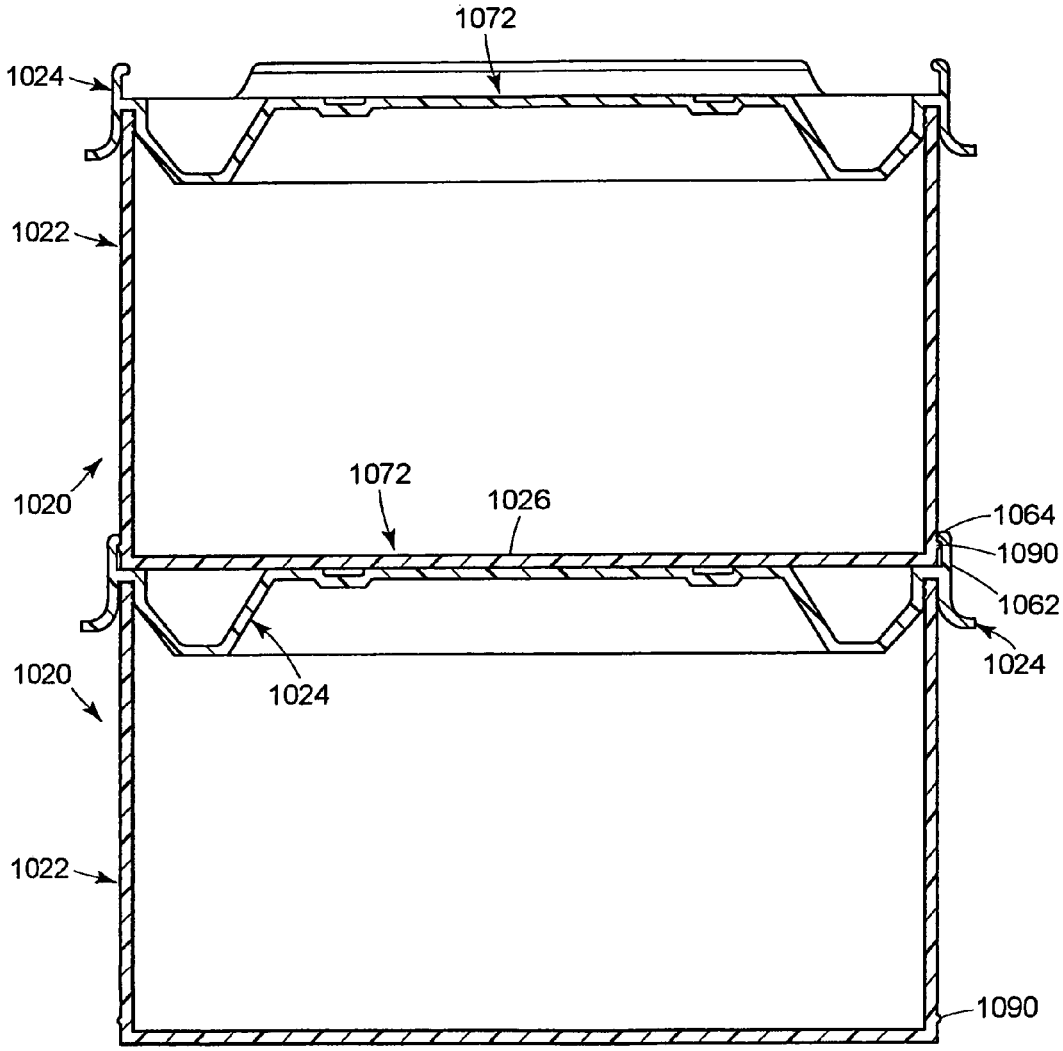
FIG. 10 is a vertical cross-sectional view of a further embodiment of a storage device including two storage devices stacked one on top of the other.

Referring now to another embodiment of the present invention shown in FIGS. 10 and 11, additional storage devices 1020 similar to storage device 20 are adapted for stacking, one on top of the other, when in the expanded position. Containers 1022 and lids 1024 are similar to the container 22 and lid 24, except for a snap-fit stacking mechanism and a lid sealing mechanism. The snap-fit stacking mechanism includes a rib 1090 extended along the bottom periphery of side walls 1028, 1030, 1032, 1034 of the container that provides a snap-fit with a lip 1064 in a retaining wall 1062 of the lid. The sealing mechanism includes a pair of sealing ridges 1092 extending continuously around the upper edge of side walls 1028, 1030, 1032, 1034. The ridges 1092 abut against the inner surface of the groove 1066 in lid 1024 when the side walls 1028, 1030, 1032, 1034 are fitted within the groove 1066. The containers 1022 are cubic in form, and the bottom wall 1026 of the container 1022 fits into the recess 1072 in the lid 1024 when in the expanded position, and either side wall 1030, 1034 of the collapsed containers 1022 fits into the recess 1072 in a similar manner as with storage device 20.

Figure 12:
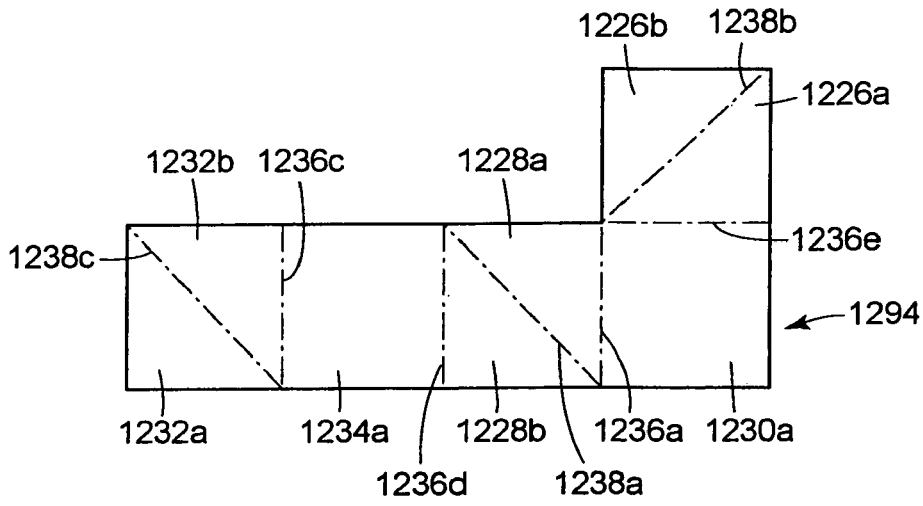
FIG. 12 is a plan view of a sheet of material to be formed into a collapsible container similar to the container of FIG. 1.

Referring now to FIG. 12, a method of forming a container similar to container 22 is shown, in which a sheet 1294 of resilient thermoformed plastic material is formed flat in a splayed form. Hinges 1238*c*, 1236*e*, 1236*a*, 1238*a*, 1236*d*, 1236*c*, and 1238*b* may be either mechanically stamped or thermoformed into the sheet 1294 between adjacent panels 1226*a,b*; 1228*a,b*; 1230*a*; 1232*a,b*; 1234*a*. When the panels 1226*a,b*; 1228*a,b*; 1230*a*; 1232*a,b*; 1234*a* are folded to form the expanded box shape of the container, the remaining hinges are formed with a flexible membrane, such as an adhesive tape, a flexible plastic, cloth, etc.

In another embodiment, the panels 1226*a,b*; 1228*a,b*; 1230*a*; 1232*a,b*; 1234*a* of the container 22 are formed of cardboard or thick paper and are hingedly connected with glue or tape; and in yet other embodiments, the panels are formed of other resilient materials and the hinges are formed of other flexible materials and joined to the panels.

Figure 13:
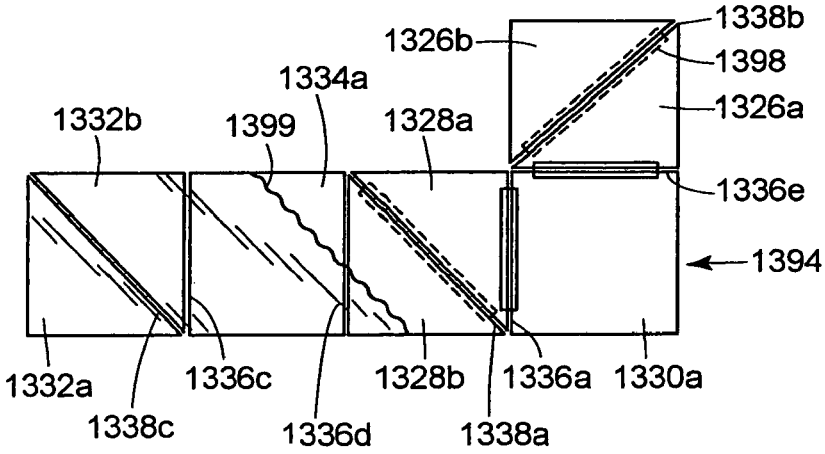
FIG. 13 is a plan view of an alternative arrangement of material to be formed into a collapsible container similar to the container of FIG. 1.
Figure 14:
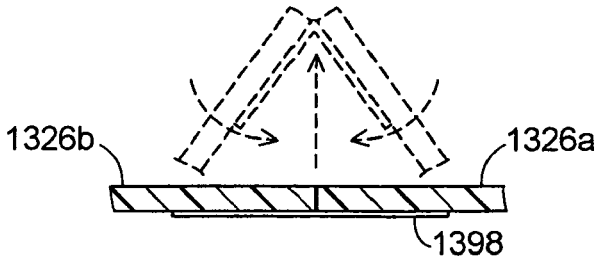
FIG. 14 is a fragmentary cross-sectional view similar to FIG. 4 of an alternative hinge.

Referring now to FIG. 13, another alternative method of forming a container similar to container 22 is shown, in which each panel 1326*a*, 1326*b*, 1328*a*, 1328*b*, 1330, 1332*a*, 1332*b*, 1334 is individually die cut from an extruded sheet of plastic. The panels are then arranged to form a splayed flat outline 1394 of the collapsible container 22 with the edges of adjacent panels butting against each other. Adjacent panels are then hingedly joined with a strip of flexible membrane 1398 such as an adhesive tape as depicted in FIG. 14. The membrane 1398 is placed on one side of the panels for interior hinges 1336*a,c,d,e*, and the membrane is placed on the opposite side of the panels for exterior hinges 1338*a-c*. Alternatively, a sheet 1399 of flexible backing material may be used to cover an entire side of the outline 1394 of the container 22. The sheet 1399 may be bonded to the panels 1226*a,b*, 1228*a,b*, 1230*a*, 1232*a,b*, 1234*a* with an adhesive, or the sheet may be thermally bonded to the panels if the sheet is made of a plastic film such as nylon, polyvinyl chloride, or a polyolefin such as polypropylene or polyethylene. In this case, some of the joints 1396 between adjacent panels would be abutting joints and some joints would be slightly spaced in order to minimize any interference between adjacent panels when folded.

Figure 15:
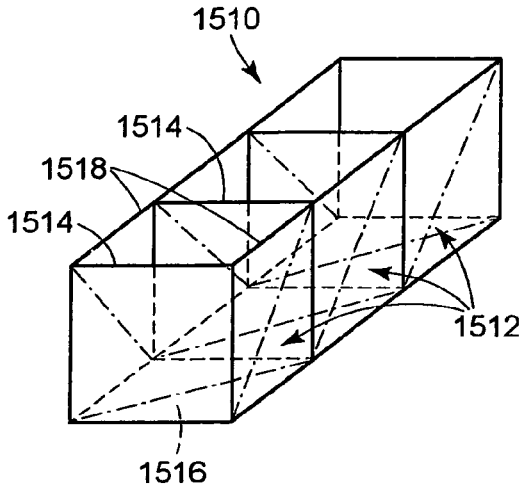
FIG. 15 is an isometric view of a multi-unit collapsible storage device according to another embodiment of the present invention.

Referring now to FIG. 15, another collapsible storage device 1510 includes three individual storage units 1512 connected side by side with each adjacent pair of storage units 1512 having a common side wall. Each storage unit 1512 is similar to container 22 in that it includes a pair of opposing square side wall panels 1514, a triangularly segmented bottom wall 1516, and triangularly segmented opposing side walls 1518 that are hingedly interconnected. The common side wall between adjacent units 1512 is one of the square panels 1514. The common side wall may be either a pair of abutting panels 1514 from two individual storage units 1512 or a single panel 1514 common to both storage units. The entire storage device 1510 may be converted between an expanded position as shown in FIG. 15 and a substantially flat collapsed position (not shown). Alternatively, any one of the individual storage units 1512 may be converted while other storage units 1512 in the storage device remain unconverted.

Figure 16:
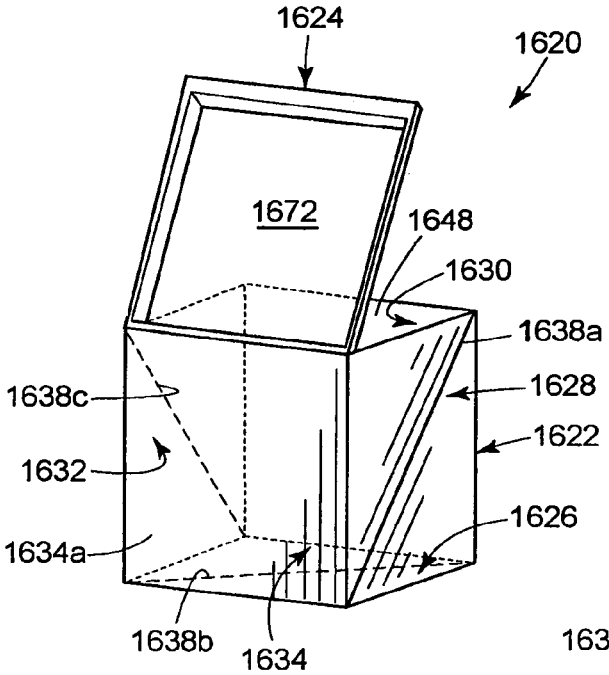
FIG. 16 is an isometric view of a storage device according to yet another embodiment of the present invention including a collapsible container and a lid hingedly attached to the container.
Figure 17:
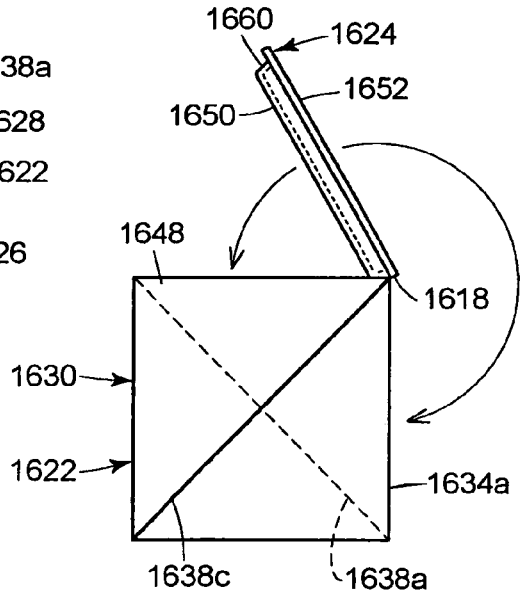
FIG. 17 is a side elevational view of the storage device of FIG. 16 with the collapsible container in an expanded position and the lid in an open position.
Figure 18:
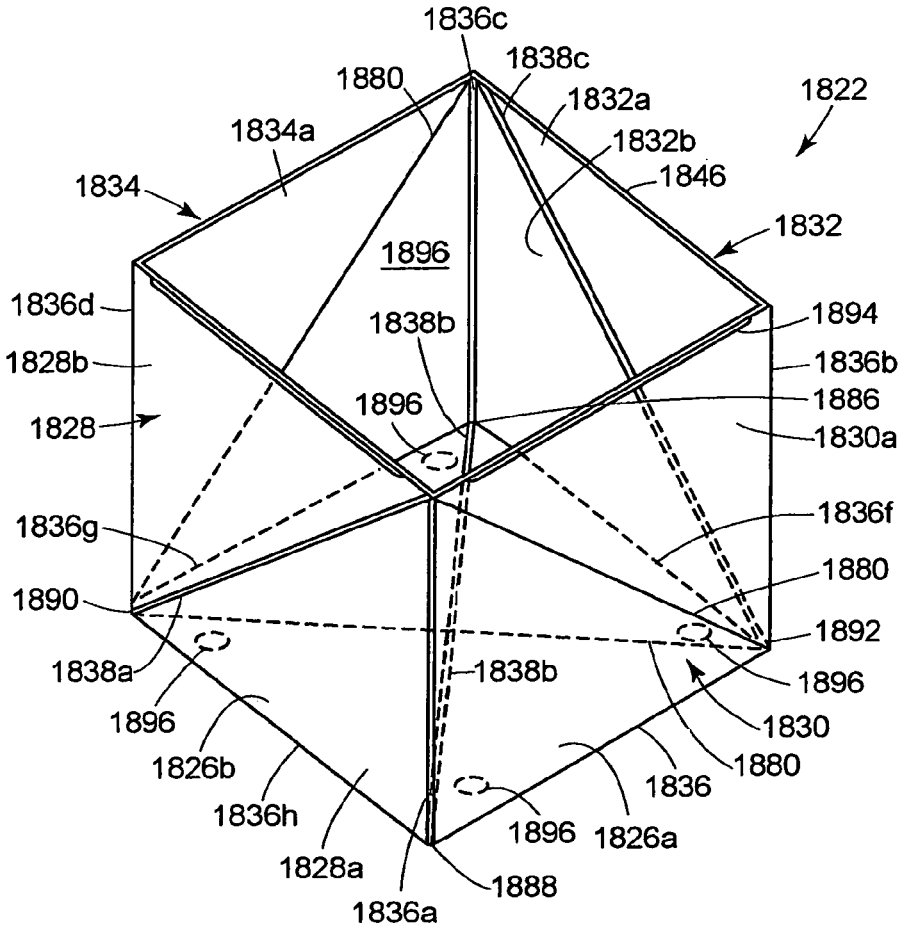
FIG. 18 is an isometric view of yet another embodiment of a collapsible container according to the present invention.
Figure 19:
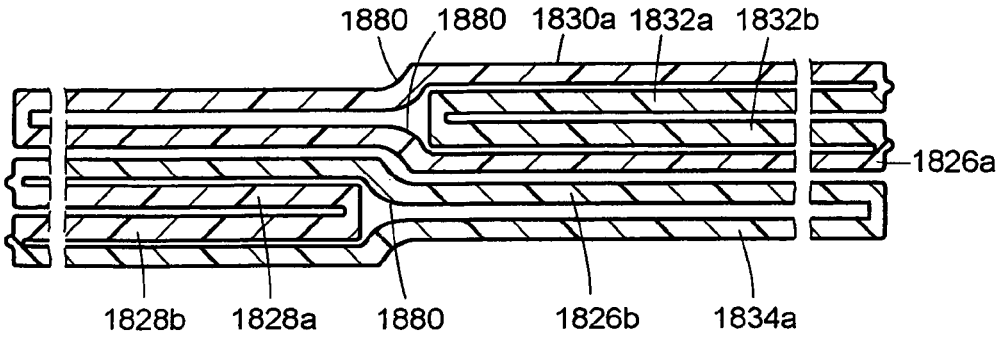
FIG. 19 is a partial cross-sectional view of the collapsible container of FIG. 18 in a collapsed position.
Figure 20:
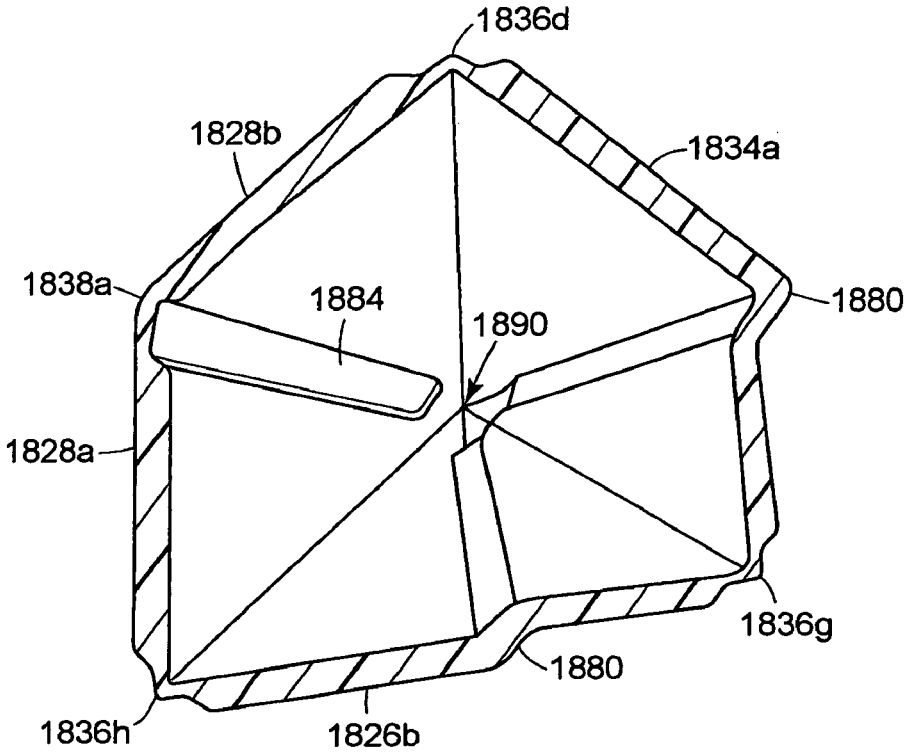
FIG. 20 is an enlarged isometric inside view in partial cross section of a single thickness corner of the collapsible container of FIG. 18.
Figure 21:
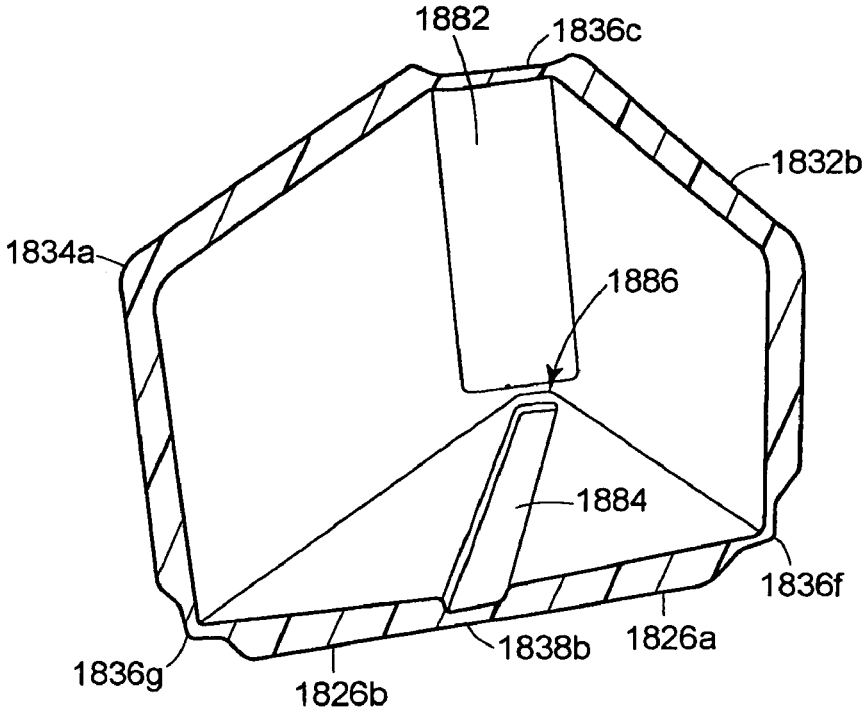
FIG. 21 is an enlarged isometric inside view in partial cross section of a double thickness corner of the collapsible container of FIG. 18.

Referring now to FIGS. 16 and 17, another storage device 1620 according to the present invention includes a collapsible container 1622 similar to container 22 and a lid 1624 similar to lid 24. The container includes a bottom wall 1626 and side walls 1628, 1630, 1632, 1634. Each of side walls 1628, 1632, and bottom wall 1626 is triangularly segmented and inwardly foldable about living hinges 1638*a*, 1638*c*, and 1638*b*, respectively, so that the container 1622 may be converted from an expanded position as shown in FIGS. 16 and 17 to a substantially flat collapsed position (not shown) in the same manner as container 22. In the expanded position, side walls 1628, 1630, 1632, 1634 define an opening 1648. The lid 1624 is attached to the container 1622 with a hinge 1618 located between one edge of the lid and the top edge of a square side wall panel 1634*a*, and is adapted to cover the opening 1648. The lid has a product side 1650 and a stacking side 1652 opposite the product side. The lid 1624 can be rotatively shifted, or articulated, around the hinge 1618 between a closed position covering the opening 1648 with the product side 1650 facing the interior of the container 1622 and an open position as shown in FIGS. 16 and 17. The lid 1624 can be further rotatively shifted around the hinge 1618 until the stacking side 1652 is adjacent to the panel 1634*a*. With the lid 1624 adjacent to the panel 1634*a*, the container 1622 may be converted to the collapsed position so that the lid and the collapsed container are substantially flat together. A recessed central portion 1672 on the stacking side 1652 of the lid 1624 forms a tapered lead-in 1660 around the outer periphery of the product side 1650 of the central portion. The lead-in 1660 is adapted to assist in shifting the lid 1624 to the closed position by urging the side walls 1628-1634 outwardly due to the taper.

In yet another embodiment of the present invention shown in FIGS. 18-21, a leak resistant plastic container 1822, which is injection molded in one embodiment, has the same fold geometry as the container 22 and includes three-dimensional side wall panels and variable width hinges. As seen in FIG.

19, each of panels 1826*a*, 1826*b*, 1830*a*, and 1834*a* includes a diagonal offset, or step 1880, located at transition points between a two-layered thickness of panels and a four-layered thickness of panels when the container is in the collapsed position. Vertical hinge 1836*c* (best seen in FIG. 21) is an inside living hinge including a hinge web 1882 having a width designed to accommodate the combined thickness of panels 1826*a* and 1826*b* between panels 1834*a* and 1832*b* in the collapsed position. Vertical hinge 1836*a* is similar to vertical hinge 1836*c*. Horizontal hinges 1836*e*, 1836*f*, 1836*g*, and 1836*h* are inside hinges having a cutaway portion on an exterior side thereof to reduce stresses therein when the container 1822 is in the collapsed position. Diagonal hinges 1838*a*, 1838*b*, and 1838*c* are outside hinges and include a hinge web 1884 smaller than hinge web 1882 to reduce the thickness of the hinges when in the collapsed position. Vertical hinge 1836*d*, horizontal hinges 1836*h* and 1836*g*, and diagonal hinge 1838*a* converge at a single thickness corner 1890, shown in FIG. 20, which is also the same as single thickness corner 1892. Vertical hinge 1836*c*, horizontal hinges 1836*g* and 1836*f*, and diagonal hinge 1838*b* converge at a double thickness corner 1886, which is also the same as double thickness corner 1888. When the container 1822 is in the expanded position, diagonal hinge 1838*b* twists along the length thereof from each corner 1886 and 1888, where the panels 1826*a* and 1826*b* are level with each other, toward an intersection with the step 1880, where the panels 1826*a* and 1826*b* are offset from each other. Protrusions, such as feet 1896, are disposed on an exterior surface of the panels 1826*a* and 1826*b* and have different heights to compensate for the offset of the panel 1826*a* from the panel 1826*b* at the step 1880 so that the expanded container 1822 sits stably when placed on a flat support surface. Each side wall 1828, 1830, 1832, and 1834 is slightly trapezoidal having an upper edge 1846 slightly longer than the bottom edge in order to provide a draft angle along the side edges each side wall of between approximately 0.75 and 1.5 degrees for molding purposes. In order to form a square opening 1896 into the container 1822, the side walls 1828 and 1832, in one embodiment, have smaller draft angles than side walls 1830 and 1834 in order to adjust for the offset caused by the steps 1880 in the panels 1830*a* and 1834*a*. In another embodiment, each side wall 1828, 1830, 1832, and 1834 has the same draft angle. In order to accommodate the draft angles, diagonal hinges 1838*a* and 1838*c* extend from double thickness corners 1890 and 1892, respectively, and terminate at a position slightly laterally offset from the upper corners of the container 1822, which allows the side wall panels to collapse without overlapping. A lip 1894 extends along an exterior side of the upper edges 1846 for snap-fit retention of a lid (not shown) when the container 1822 is in the expanded position. In one embodiment, each of the panels 1828*a*, 1828*b*, 1830*a*, 1832*a*, 1832*b*, 1834*a*, 1826*a*, and 1826*b* has a substantially constant thickness. In another embodiment, one or a combination of multiple ones of the panels 1828*a*, 1828*b*, 1830*a*, 1832*a*, 1832*b*, 1834*a*, 1826*a*, and 1826*b* has a varying thickness to accommodate structural and manufacturing purposes, such as offsetting warpage caused by bending of the completed container or by cooling of recently formed panels. In a further embodiment, the panels are formed of polypropylene having a thickness between about 0.01 inch and 0.04 inches, and the hinges are formed of polypropylene having a thickness between about 0.005 inches and 0.015 inches. In a still further embodiment, the panels have a thickness between about 0.5 inches and about 0.001 inches and the hinges have a thickness between about 0.3 inches and about 0.0001 inches.

Figure 22A:
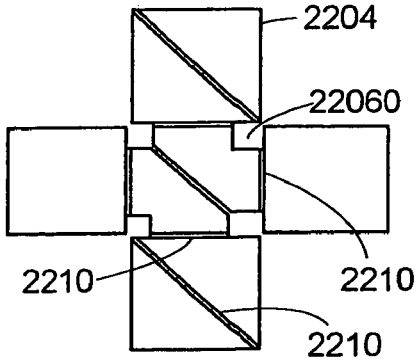
FIGS. 22A, 22B, and 22C are diagrammatic views of a collapsible container at three stages in a method of manufacturing according to one embodiment of the present invention.
Figure 22B:
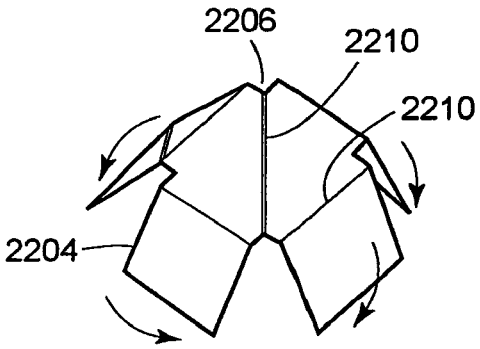
Figure 22C:
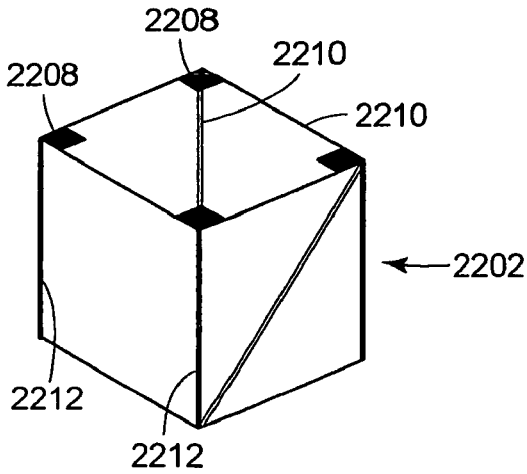

FIGS. 22A-22C show steps in another method of forming a collapsible container 2202, such as any of the collapsible containers described herein, in a thermoform overmold process according to the present invention. A splayed outline 2204 of the container 2202 is formed from a flat panel of material, such as by die cutting a panel of thermoplastic, including holes, or gaps 2206, where bottom corners 2208 of the container 2202 will be located. Hinges 2210 between adjacent interconnected panels in the splayed outlined and any lips or other indentations or surface irregularities are imparted, such as by pressing or coining, to the splayed outline. The splayed outline 2204 is then folded through an intermediate position shown in FIG. 22C into an assembled expanded position and inserted into an injection mold die, where a molten hinge material is injected to fill the bottom corners 2208 and between adjacent unconnected panels to form vertical hinges 2212 as shown in FIG. 22C. Material forming the hinges 2212 in one embodiment is more flexible than the resilient material forming the panels. The mold may include four injection points and a vacuum assist to assist forming the hinges. In another embodiment, the hinges 2210 may be formed prior to die cutting the splayed outline 2204 or by a thermoforming process.

Figure 23A:
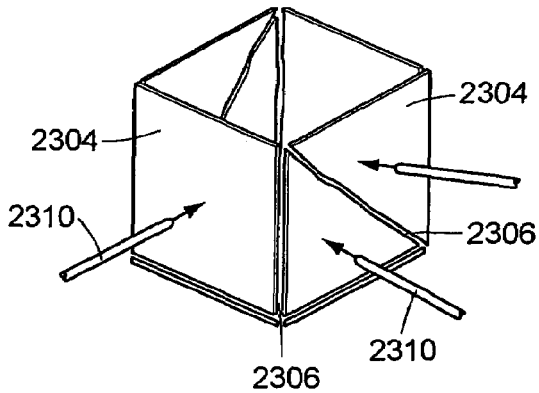
FIGS. 23A and 23B are diagrammatic isometric views of a collapsible container at two stages in a method of manufacturing according to another embodiment of the present invention.
Figure 23B:
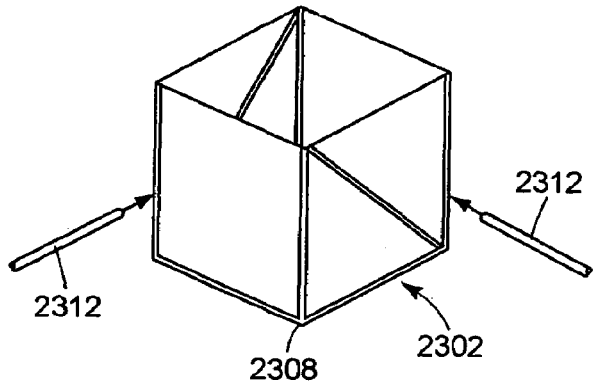

Turning now to FIGS. 23A and 23B, two steps in a two-shot injection molding method of making a collapsible container 2302 having walls formed of hingedly connected panels 2304 according to the present invention, such as any of the collapsible containers described herein, are diagrammatically shown. In a first step, shown in FIG. 23A, a first molten material is injected into an injection mold (not shown) at the location of each panel 2304 in the container with, for example, injection ports 2310, to separately form each panel and provide a hinge space 2306 between each adjacent panel. In a second step, a second molten material is injected into the injection mold along the hinge spaces 2306 with, for example, injection ports 2312, to form hinges 2308 between adjacent panels 2304. In one embodiment, the first molten material is a thermoplastic resin that forms a rigid panel when cooled, and the second molten material is a thermoplastic resin that is more flexible than the first molten material when cooled. In another embodiment, the hinges 2308 may be formed first and the panels 2304 may be formed second. In a further embodiment, the hinges are pre-formed from a flexible material, such as plastic resins, cloth, metal, or composite material, fitted into an injection mold along the hinge locations, and molten material for each of the panels 2304 is injected using injection ports 2310 disposed at each panel location to form the panels to the pre-formed hinges.

Figure 24A:
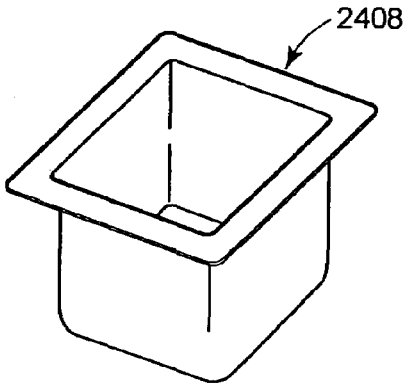
FIGS. 24A and 24B are diagrammatic isometric views of a collapsible container at two stages in a method of manufacturing according to yet another embodiment of the present invention.
Figure 24B:
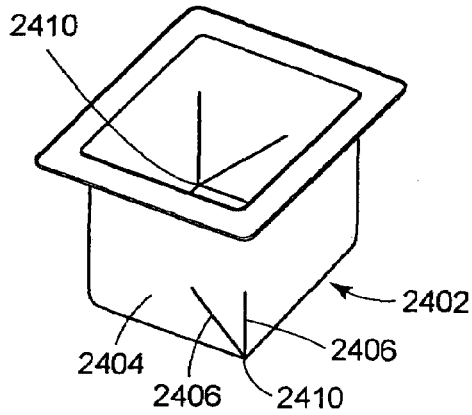

A multi-step thermoforming method of making a collapsible container 2402 according to the present invention is shown diagrammatically in FIGS. 24A and 24B. The container, shown partly formed at 2402, includes wall panels 2404 articulably interconnected by living hinges 2406 similar to any one of the collapsible containers described herein. In a first step shown in FIG. 24A, a plastic blank 2408 is formed by any suitable process, such as blow molding, thermoforming, or injection molding, having the general size and shape of the expanded collapsible container 2402. The plastic blank 2408 may be made of polyvinyl chloride, a polyolefin such as polypropylene, or any other appropriate formable plastic material. In a second step, shown partly completed in FG. 24B, each bottom corner 2410 of the collapsible container 2402 and a portion of each living hinge 2406 originating at each corner are coined into the cube blank by a three-dimensional corner die having an inner male corner die part and an outer female corner die part (not shown). In one embodiment, each entire corner 2410 (and the hinges 2406 originating therefrom) is coined at one time in order to reduce the chance of leakage in the corner during use of the container 2402 by a future user. In a further step, the remaining portions of the living hinges 2406 are then coined between adjacent corners with appropriate die, thereby forming the completed container 2402. The coining operation may be performed hot, with the die and/or the plastic cube blank material heated, or cold. In one embodiment, the container 2402 is then converted to the collapsed position and mated with a lid, such as lid 24 or any other lid described herein, that has been formed on a parallel vacuum forming, thermoforming, or injection molding operation in a manner well known in the art. The collapsed container 2402 and a lid, such as the lid 24, are mated such that the container is stacked into the recess 72 of the lid. The container 2402 and lid 24, which form a single unit storage device, such as storage device 20, are then packaged for shipping and distribution.

Another method of forming any of the collapsible containers described herein is by a single charge injection molding process using a material such as polyethylene or polypropylene, and blends thereof including elastomers for increased flexibility.

Figure 25A:
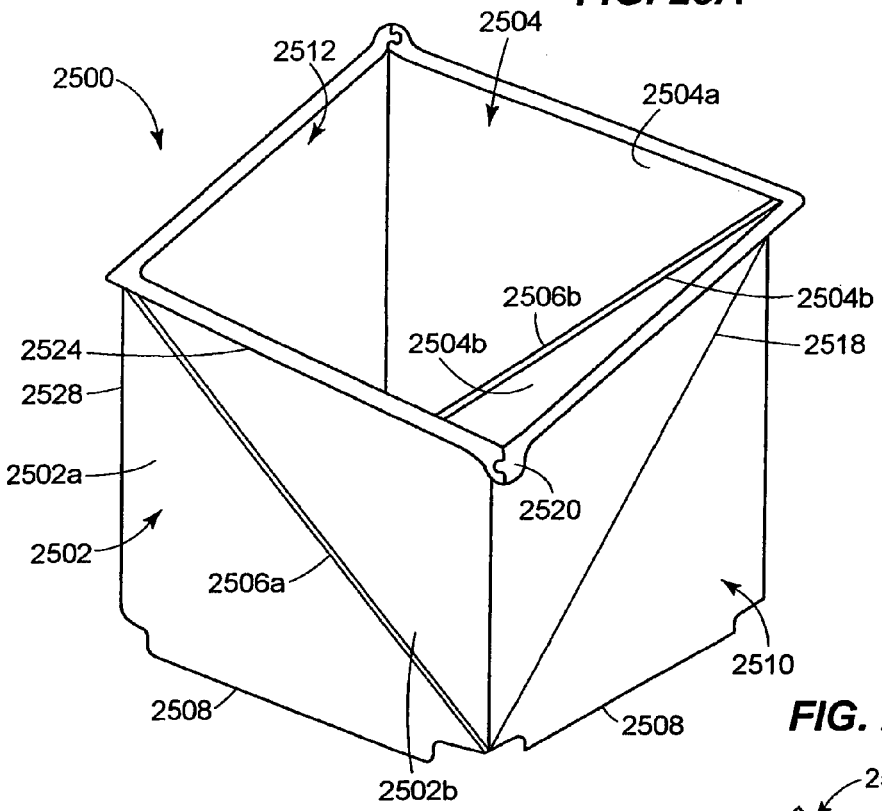
FIG. 25A is an isometric view of a collapsible container according to a further embodiment of the present invention.
Figure 25C:
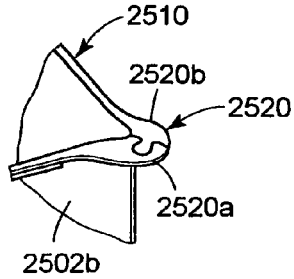
FIG. 25C is an enlarged partial isometric view of an interlocking mechanism on the collapsible container of FIG. 25A.
Figure 25B:
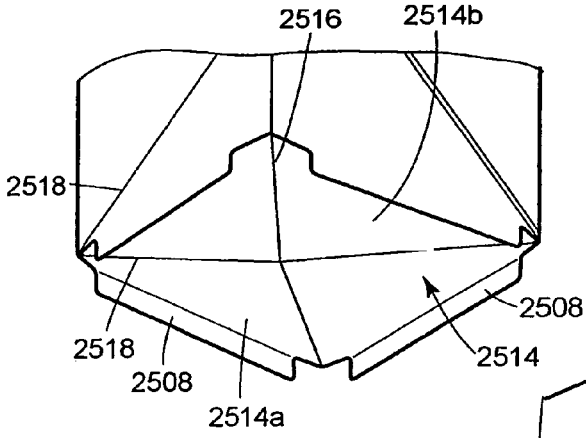
FIG. 25B is a partial isometric view of a bottom side of the collapsible container of FIG. 25A.
Figure 25D:
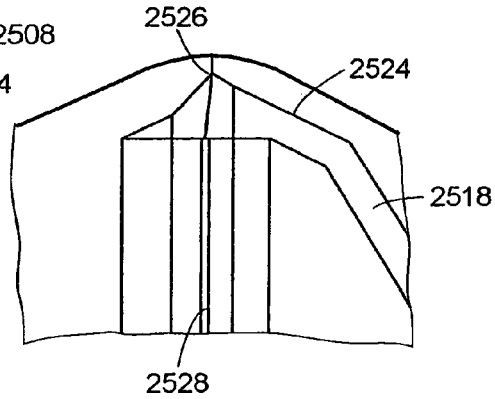
FIG. 25D is an enlarged partial isometric view of an upper corner on the collapsible container of FIG. 25A.

In FIGS. 25A-25D, another collapsible container 2500 according to the present invention is shown. The collapsible container 2500 is similar to the collapsible container 22 in that opposing side walls 2502 and 2504 are divided into opposing triangular panels 2502*a*, 2502*b*, 2504*a*, and 2504*b* by diagonal hinges 2506*a* and 2506*b*. In addition, legs 2508 extend downwardly from each of the side walls 2502, 2504, 2510, and 2512 beyond bottom wall 2514 to form a cavity or space between the bottom wall and a supporting surface (not shown) when the container 2500 is laid on the supporting surface in the expanded position. The bottom wall 2514 (best seen in FIG. 25B) is divided into two triangular panels 2514*a* and 2514*b* by a diagonal hinge 2516, which is an out-of-plane arched hinge. Steps 2518 formed in side walls 2510 and 2512 and bottom wall 2514 are adapted to allow the collapsible container 2500 to collapse substantially flat over different numbers of panel layers in the collapsed position. A locking mechanism 2520 (best shown in FIG. 25C) is located at opposite vertical corners to automatically lock the collapsible container 2500 in the expanded position when the collapsible container is converted from the collapsed position to the expanded position. The locking mechanism 2520 includes a first interlocking portion 2520*a* extending from panel 2502*b* and a second interlocking portion 2520*b* extending from the side wall 2510. The first interlocking portion 2520*a* automatically releasably interlocks with the second interlocking portion 2520*b* when the collapsible container 2500 is converted into the expanded position. As shown in FIG. 25D, a lip 2524 extending along an outer periphery of an upper edge of the container has a slit 2526 therethrough located at the corners of the collapsible container extending inwardly to the vertical hinge 2528.

Figure 26:
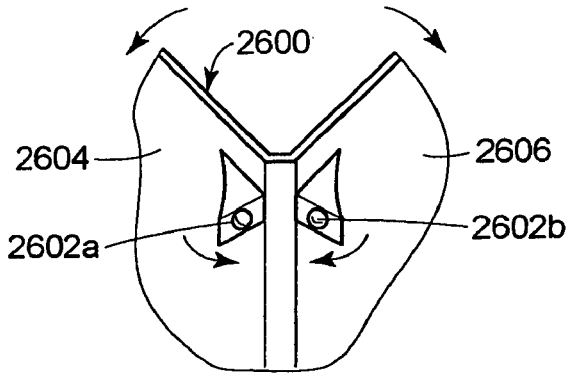
FIG. 26 is an enlarged partial isometric view of another interlocking mechanism on a collapsible container of the present invention.
Figure 27:
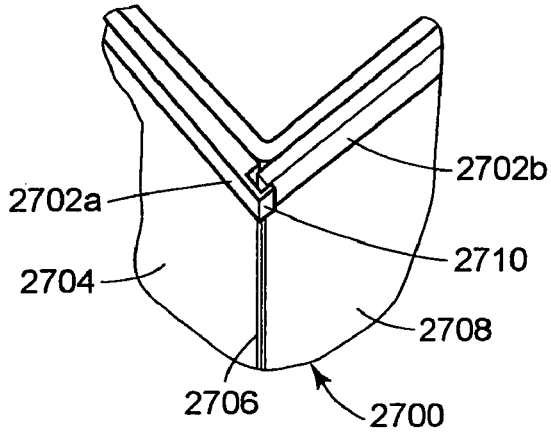
FIG. 27 is an enlarged partial isometric view of still another interlocking mechanism on a collapsible container of the present invention.

In FIG. 26, a collapsible container 2600 according to the present invention includes another locking mechanism 2602 having a first interlocking socket portion 2602*a* carried by one side wall panel 2604 that automatically releasably interlocks with a second interlocking ball portion 2602*b* carried by an adjacent side wall panel 2606 when the collapsible container is in the expanded position. FIG. 27 shows yet another locking mechanism 2702 suitable for use with a collapsible container of the present invention having a first interlocking arm 2702*a* and a second interlocking arm 2702*b*. The first interlocking arm 2702*a* extends from side wall panel 2704 past vertical corner 2706, and the second interlocking arm 2702*b* extends from side wall panel 2708 past the vertical corner. The first interlocking arm 2702*a* automatically interlockingly engages the second interlocking arm 2702*b*. A tab 2710 at the end of the first interlocking arm 2702*a* extends beyond the second interlocking arm 2702*b* to allow a user to unlatch the interlocking arms for disengagement.

Figure 28:
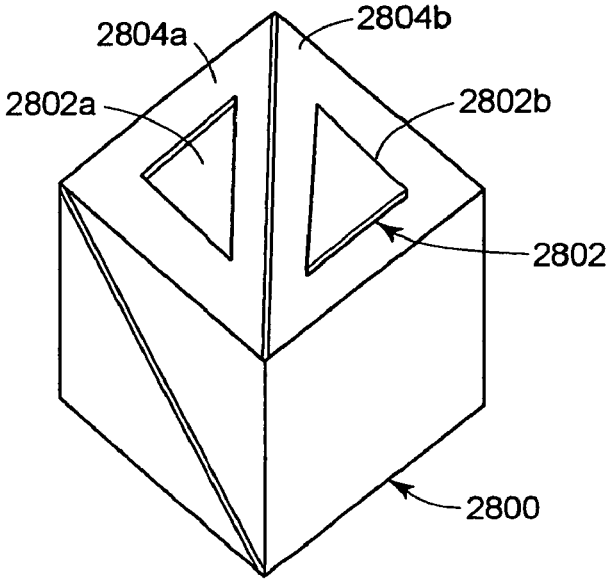
FIG. 28 is an isometric view of a collapsible container according to a further embodiment of the present invention.

Turning now to FIG. 28, another collapsible container 2800 according to the present invention includes an interlocking mechanism 2802 for releasably locking the collapsible container in the collapsed position. In one embodiment, the interlocking mechanism includes a first interlocking portion having a depression 2802*a* disposed on a first bottom panel 2804*a* and a second interlocking portion having a protrusion 2802*b* disposed on a second bottom panel 2804*b*. The protrusion 2802*a* interlocks with the depression 2802*b* by a snap-fit or interference fit when the collapsible container is in the collapsed position. In another embodiment (not shown), the first and second interlocking portions 2802*a* and 2802*b* have other complementary interlocking shapes and are disposed on other wall panels of the collapsible container that opposingly face each other when the collapsible container 2800 is in the collapsed position.

Figure 29A:
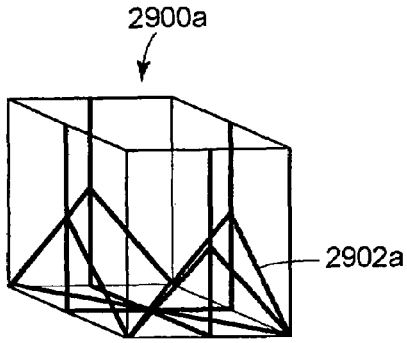
FIGS. 29A-29J are diagrammatic isometric views of yet other embodiments of collapsible containers according to the present invention.
Figure 29B:
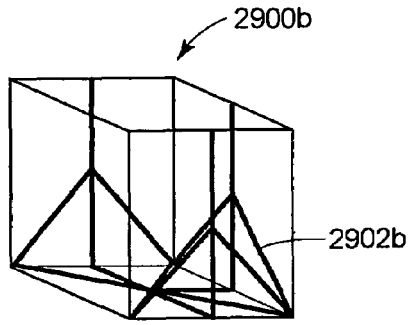
Figure 29C:
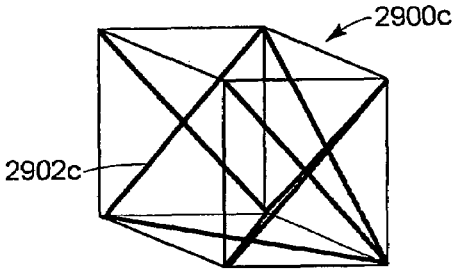
Figure 29D:
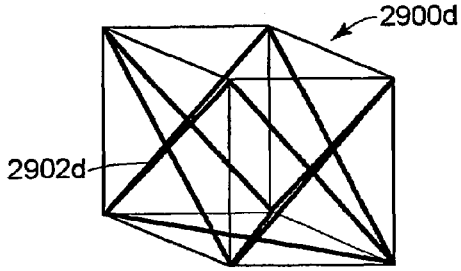
Figure 29E:
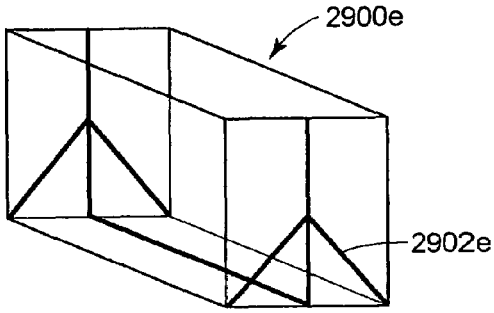
Figure 29F:
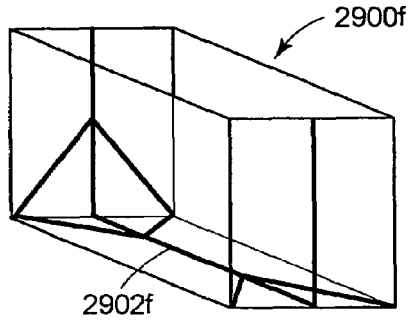
Figure 29G:
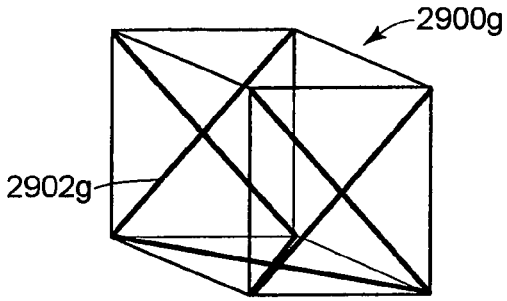
Figure 29H:
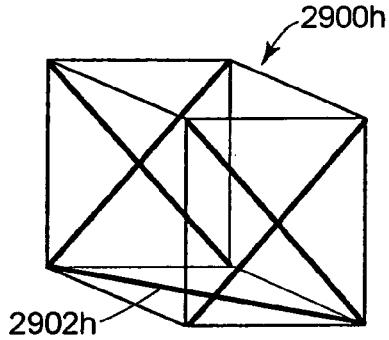
Figure 29I:
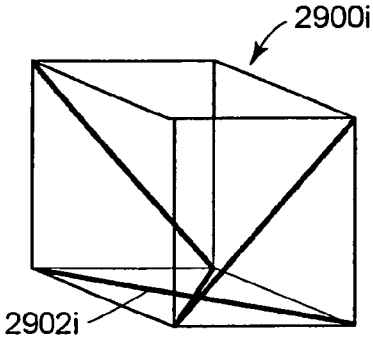
Figure 29J:
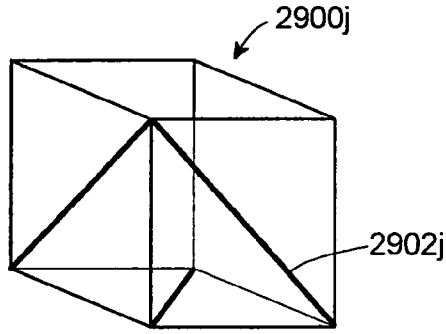

Turning now to FIGS. 29A-29J, a number of collapsible containers according to the present invention, each including a bottom wall and four side walls, have flexible hinges articulably connecting each adjacent pair of resilient wall panels in patterns facilitating different fold geometries that allow the collapsible container to convert between a substantially flat collapsed position and a substantially cubic or substantially rectangular prismatic expanded position. Each of the fold geometries facilitates a different collapsing motion between the expanded position and the collapsed position. In FIG. 29A, a substantially cubic collapsible container 2900*a* includes wall panels joined by hinges 2902*a*. The hinges are in a generally inverted Y pattern on all four side walls and in a radial star pattern on the bottom wall extending from a central point on the bottom wall to each hinge on the side walls. In FIG. 29B, a substantially cubic collapsible container 2900*b* includes wall panels joined by hinges 2902*b* having a generally inverted Y pattern on three side walls and in a radial star pattern on the bottom wall. A substantially cubic collapsible container 2900*c*, shown in FIG. 29C, and a substantially cubic collapsible container 2900*d*, shown in FIG. 29D, each include wall panels joined by hinges 2902*c* and 2902*d*, respectively, having an X pattern on three side walls and four side walls, respectively, and having an X pattern on each bottom wall. In FIG. 29E, a substantially rectangular prismatic collapsible container 2900*e* includes hinges 2902*e* having a generally inverted Y pattern on opposite non-square rectangular end walls and disposed medially along the bottom wall. In FIG. 29F, a substantially rectangular prismatic collapsible container 2900*f* includes hinges 2902*f* having a generally inverted Y pattern on opposite end walls and opposing Y patterns on the bottom wall. A substantially cubic collapsible container 2900*g*, shown in FIG. 29G, has hinges 2902*g* in an X pattern on opposite end walls and the bottom wall. Another substantially cubic collapsible container 2900*h*, shown in FIG. 29H, includes hinges 2902*h* in an X pattern on opposite end walls and diagonally disposed across the bottom wall. In FIG. 29I, a near cubic collapsible container 2900*i* has hinges 2902*i* in an X pattern on a bottom wall and diagonally disposed across opposite side walls. A substantially cubic collapsible container 2900*j*, shown in FIG. 29J, includes hinges 2902*j* diagonally disposed across the bottom wall and two adjacent side walls.

Other embodiments of the invention including all the possible different and various combinations of the individual features of each of the foregoing described embodiments are specifically included herein.

INDUSTRIAL APPLICABILITY

A storage device having a collapsible container and lid according to the present invention may be used to store any of many types of items or substances. The collapsible container and lid may have any convenient size ranging from very small to very large. A specific use contemplated for the storage device is for the containment and storage of food products (not shown). The food products are stored within the interior of the collapsible container when in the expanded position, and the lid is used to close the collapsible container. When no food products are stored in the storage device, the collapsible container may be collapsed to the collapsed position and placed within a recess in the lid to provide for convenient storage of the entire storage device in a compact form.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is reserved.

We claim:

1. A storage device comprising:

a container including a plurality of resilient wall panels defining four side walls and a bottom wall, wherein each of two opposing side walls and the bottom wall are defined by a diagonal flexible hinge extending between opposing substantially triangular wall panels and each of the two remaining side walls are defined by a substantially rectangular wall panel, and wherein each adjacent pair of wall panels is joined by a flexible hinge such that the container is articulably convertible about the hinges between a substantially flat collapsed position and an expanded position defining an opening into an interior of the container, and wherein at least one of rectangular wall panels includes a step between non-coplanar sections and extending diagonally between opposite corners of the rectangular wall panel; and a lid that receives the container in the collapsed position and sealingly covers the opening of the container in the expanded position.

2. The storage device of claim 1, wherein the lid includes a cover plate that covers the opening and a groove recessed into a first side of the cover plate, wherein the groove sealingly receives a top edge of the four side walls that extends around the opening.

3. The storage device of claim 2, wherein the lid further includes a recess on a second side of the cover plate opposite the first side that is adapted to receive the container in the collapsed position.

4. The storage device of claim 3, wherein the container snap fits into the recess when the container is in the collapsed position.

5. The storage device of claim 1, wherein the step is located along a transition point between a two-layered thickness of wall panels and a four-layered thickness of panels when the container is in the collapsed position.

6. The storage device of claim 5, wherein each hinge forms a liquid impervious connection extending between the adjacent pair of side walls disposed on opposite sides thereof.

7. A container comprising a plurality of resilient wall panels defining four side walls and a bottom wall, wherein each of two opposing side walls and the bottom wall are defined by a diagonal flexible hinge extending between opposing substantially triangular wall panels and each of the two remaining side walls are defined by a substantially rectangular wall panel, and wherein each adjacent pair of wall panels is joined by a flexible hinge such that the container is articulably convertible about the hinges between a substantially flat collapsed position and an expanded position defining an opening into an interior of the container, and wherein at least one of rectangular wall panels includes a step between non-coplanar sections and extending diagonally between opposite corners of the rectangular wall panel.

8. The container of claim 7, wherein the flexible hinges are living hinges forming a liquid impervious connection between each adjacent pair of wall panels.

9. The container of claim 7, wherein at least one of the living hinges is an arched living hinge.

10. The container of claim 9, wherein the arched living hinge is an out-of-plane arched living hinge.

11. The container of claim 7, wherein at least one of the hinges disposed between two of the substantially triangular wall panels has a terminal end laterally displaced from a corner of the side wall.

12. The container of claim 7, further comprising a lid articulably attached to one of the side walls with a hinge, wherein the lid includes a closed position covering the opening.

13. The container of claim 7, wherein at least one of the flexible hinges is a living hinge.

14. The container of claim 7, wherein at least one of the flexible hinges is an arched hinge.

15. The container of claim 7, wherein one of the flexible hinges is an inside living hinge, wherein the inside living hinge comprises a web having a width that is sufficient to accommodate the combined thickness of two wall panels stacked between the adjacent panels connected by the inside living hinge when the collapsible container is in the collapsed position.

16. The container of claim 7, wherein the flexible hinges and the wall panels are integrally formed of a polymeric material.

17. The container of claim 7, wherein in at least one of the flexible hinges is a first flexible material and at least one of the wall panels is a second resilient material.

18. The container of claim 7, further including a first interlocking member disposed on a first wall panel and a second interlocking member disposed on a second wall panel adjacent to the first wall panel, wherein the first interlocking member releasably interlocks with the second interlocking member when the collapsible container is in the expanded position.

19. The container of claim 7, and an interlocking mechanism disposed on wall panels that are opposing when the collapsible container is in the collapsed position, wherein the interlocking mechanism releasably maintains the collapsible container in the collapsed position.

* * * * *